United States Patent [19]

Dilmore et al.

[11] 4,402,809

[45] Sep. 6, 1983

[54] BIPOLAR ELECTROLYZER

[75] Inventors: Colonel R. Dilmore, Portland; Carl W. Raetzsch, Jr., Corpus Christi, both of Tex.

[73] Assignee: PPG Industries, Inc., Pittsburgh, Pa.

[21] Appl. No.: 299,247

[22] Filed: Sep. 3, 1981

[51] Int. Cl.[3] ..... C25B 9/00; C25B 9/04

[52] U.S. Cl. ..... 204/254; 204/255; 204/256; 204/268

[58] Field of Search ..... 204/254–256, 204/268, 98, 128

[56] References Cited

U.S. PATENT DOCUMENTS

| | | | |
|---|---|---|---|
| 3,222,270 | 12/1965 | Edwards | 204/269 |
| 3,242,059 | 3/1966 | Cottam et al. | 204/98 |
| 3,242,065 | 3/1966 | Messner et al. | 204/256 |
| 3,324,023 | 6/1967 | Kircher | 204/256 |
| 3,403,083 | 9/1968 | Currey et al. | 204/98 |
| 3,616,328 | 10/1971 | Currey et al. | 204/98 |
| 3,640,804 | 2/1972 | Westerlund | 204/98 |
| 3,723,266 | 3/1973 | Currey | 204/98 |
| 3,755,108 | 8/1973 | Raetzsch et al. | 204/256 |
| 3,759,813 | 9/1973 | Raetzsch et al. | 204/256 |
| 3,759,815 | 9/1973 | Larsson | 204/268 |
| 3,775,283 | 11/1973 | Eisele et al. | 204/268 |
| 3,788,966 | 1/1974 | Stephenson | 204/256 |
| 3,824,173 | 7/1974 | Bouy et al. | 204/284 |
| 3,849,280 | 11/1974 | Raetzsch et al. | 204/256 |
| 3,855,091 | 11/1974 | Piester | 204/128 |
| 3,856,651 | 12/1974 | Raetzsch et al. | 204/256 |
| 3,859,197 | 1/1975 | Bouy et al. | 204/284 |
| 3,884,792 | 5/1975 | McGilvery | 204/290 F |
| 3,950,239 | 4/1976 | Figueras | 204/254 |
| 3,960,699 | 6/1976 | Bortak et al. | 204/268 |
| 3,968,021 | 7/1976 | Rahn et al. | 204/256 |
| 3,980,545 | 9/1976 | deLachaux | 204/286 |
| 4,057,473 | 11/1977 | Cunningham et al. | 204/98 |
| 4,076,603 | 2/1978 | Andersen | 204/98 |
| 4,111,779 | 9/1978 | Seko et al. | 204/255 |
| 4,116,805 | 9/1978 | Ichisaka | 204/290 |
| 4,137,144 | 1/1979 | Kenney | 204/268 |
| 4,141,815 | 2/1979 | Ichisaka | 204/290 |
| 4,196,068 | 4/1980 | Scoville | 204/255 |
| 4,197,179 | 4/1980 | Ezzell et al. | 204/255 |
| 4,198,277 | 4/1980 | Kurtz et al. | 204/98 |
| 4,204,920 | 5/1980 | Kurtz et al. | 204/98 |
| 4,222,831 | 9/1980 | Specht et al. | 204/98 |
| 4,236,983 | 12/1980 | Minz et al. | 204/129 |
| 4,256,562 | 4/1981 | Mose et al. | 204/258 |
| 4,268,365 | 5/1981 | Iijima et al. | 204/98 |
| 4,279,731 | 7/1981 | Pellegri | 204/254 |
| 4,293,395 | 10/1981 | Iijima | 204/98 |

FOREIGN PATENT DOCUMENTS

| | | | |
|---|---|---|---|
| 1087546 | 10/1980 | Canada | 204/64 |

*Primary Examiner*—R. L. Andrews

*Attorney, Agent, or Firm*—Richard M. Goldman

[57] ABSTRACT

Discloses a permionic membrane bipolar electrolyzer for the electroylsis of aqueous alkali metal chlorides. The electrolyzer is characterized by having a minimum anode to cathode gap, e.g., the anode and cathode both in contact with the permionic membrane, and by having means to prevent the diffusion of nascent hydrogen between adjacent electrolytic cells.

24 Claims, 29 Drawing Figures

BIPOLAR ELECTROLYZER

DESCRIPTION OF THE INVENTION

Chlorine and aqueous alkali metal hydroxides, e.g, sodium hydroxide and potassium hydroxide, may be prepared by the electrolysis of aqueous alkali metal chlorides, e.g., sodium chloride and potassium chloride, in an electrolytic cell having an anolyte compartment separated from a catholyte compartment by a permionic membrane therebetween.

One particular type of electrolytic cell structure particularly suited for the large scale electrolysis of aqueous alkali metal chlorides is a bipolar electrolyzer. A bipolar electrolyzer contains a plurality of individual electrolytic cells electrically and mechanically in series. The series structure is provided by a sequential replication of common structural units, i.e., bipolar units, also known as bipolar elements. The sequence of these common structural units, i.e., the number of cells in the electrolyzer, is generally three or more, for example, ten or even twenty or more, depending upon the availability of electrical power and transformer capacity.

Bipolar electrolyzers when further combined with planar electrodes substantially in contact with the permionic membrane offer a compact structure and economies of construction, operation, and maintenance.

As herein contemplated a bipolar electrolyzer is provided having a bipolar element of high electrical conductivity and high resistance to hydride formation, an electrode configuration characterized by planar electrode elements in close proximity to the permionic membranes on either surface thereof and preferably contacting the permionic membranes so as to provide low electrolyte IR drop, and an electrolyte recirculation system. The electrolyte recirculation system is characterized by removal of product gases, e.g., chlorine or hydrogen, with electrolyte as a forth of electrolyte and gas under flow conditions that avoid pressure fluctuations and transients across the individual permionic membranes, maintain the electrolyte chemistries substantially invariant with time and between cells, and have combined therewith means for avoiding stray current leakage between cells.

THE FIGURES

The invention, including various exemplifications and embodiments thereof, may be understood by references to the Figures.

Figure 18:
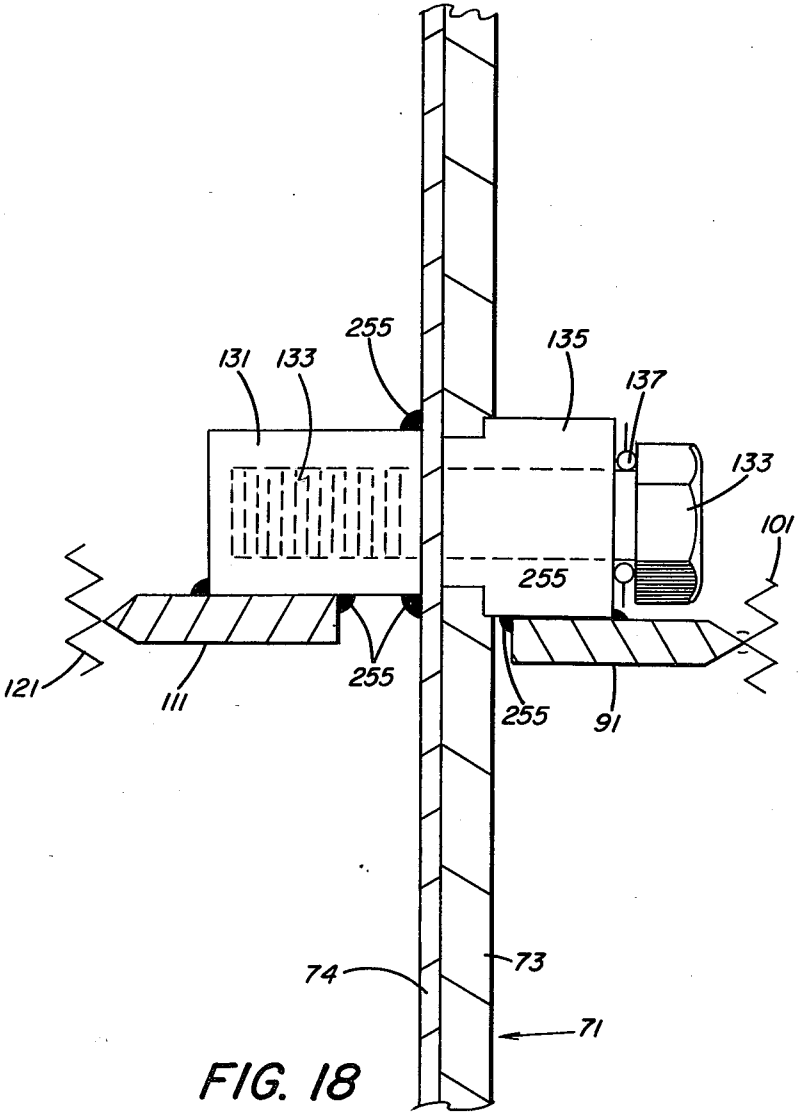

FIG. 18 is an element of a sectional plan view of a bipolar element having a valve metal base for the anodic compartment, a transition metal base for the cathodic compartment, an internally threaded valve metal conductor welded to the valve metal conductor in the anolyte compartment, and a threaded bolt passing through the transition metal base and the valve metal base to the threaded valve metal conductor.

Figure 19:
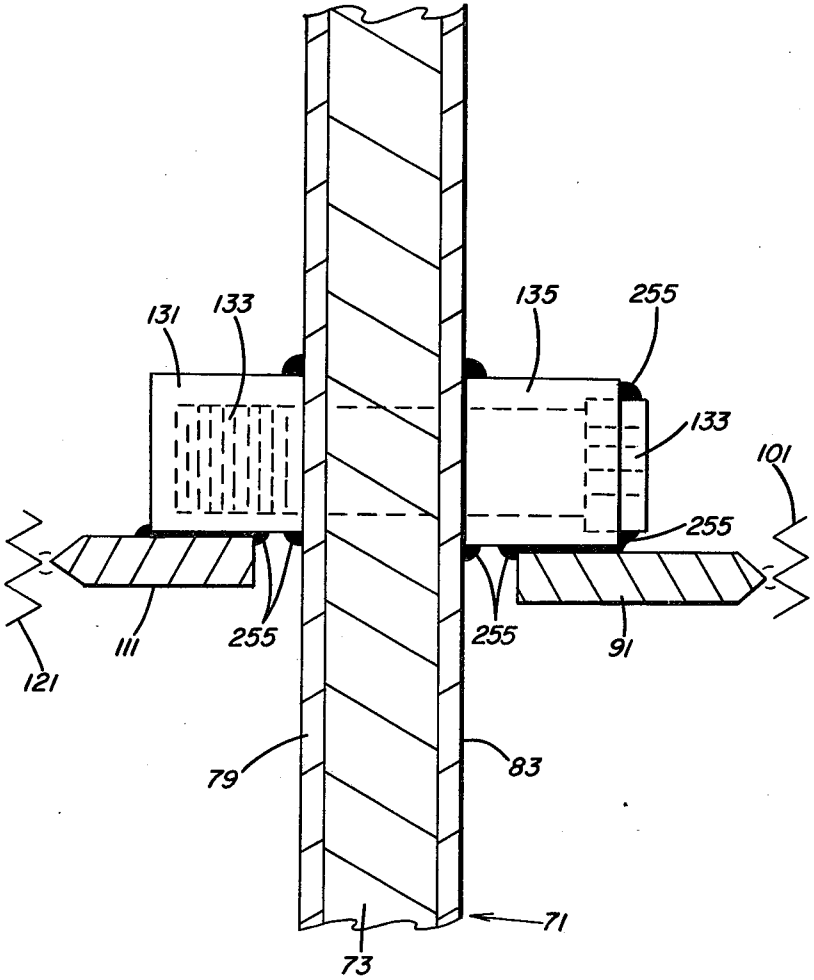

FIG. 19 is an element of a sectional plan view of a bipolar element having a clad metal barrier with a transition metal sheet on the cathodic side of the barrier, and the anode conductor depending from a threaded nut and held in place by a threaded bolt extending from the cathode side.

Figure 20:
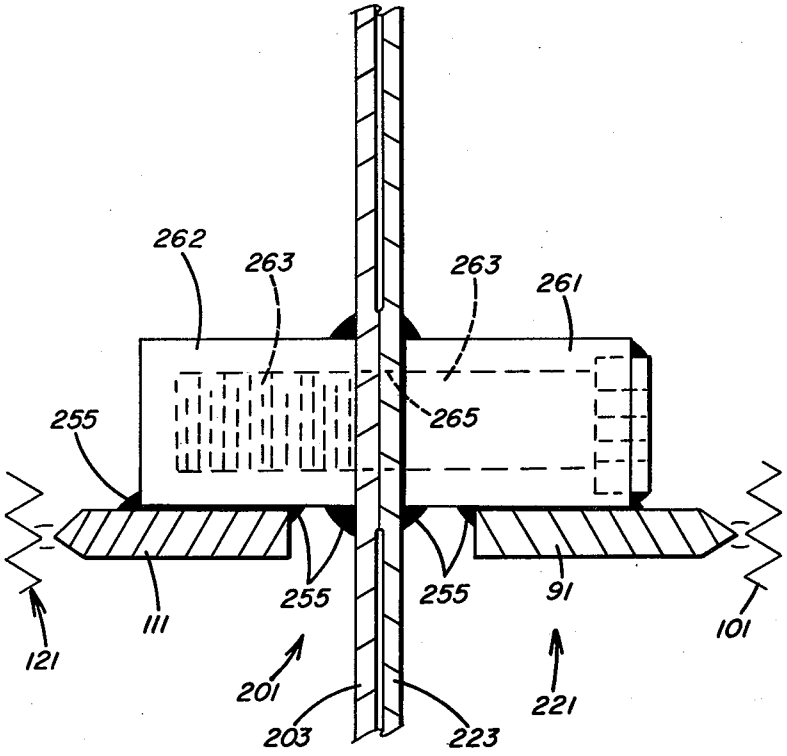

FIG. 20 is an element of a sectional plan view of a bipolar element having an anode base with an internally threaded cylinder on the anodic surface, and a threaded bolt extending from the cathodic base, and holding the bipolar element in compression.

Figure 21:
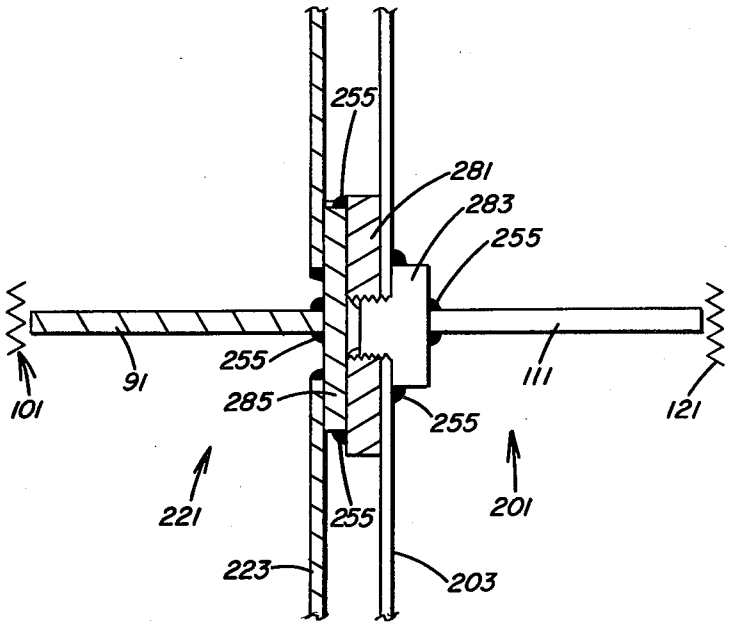

FIG. 21 is an element of a sectional plan view of a bipolar element having a welded bimetallic conductor between the anode base and the cathode base, the welded bimetallic conductor being held in place by a threaded valve metal stud passing through the anode base.

Figure 22:
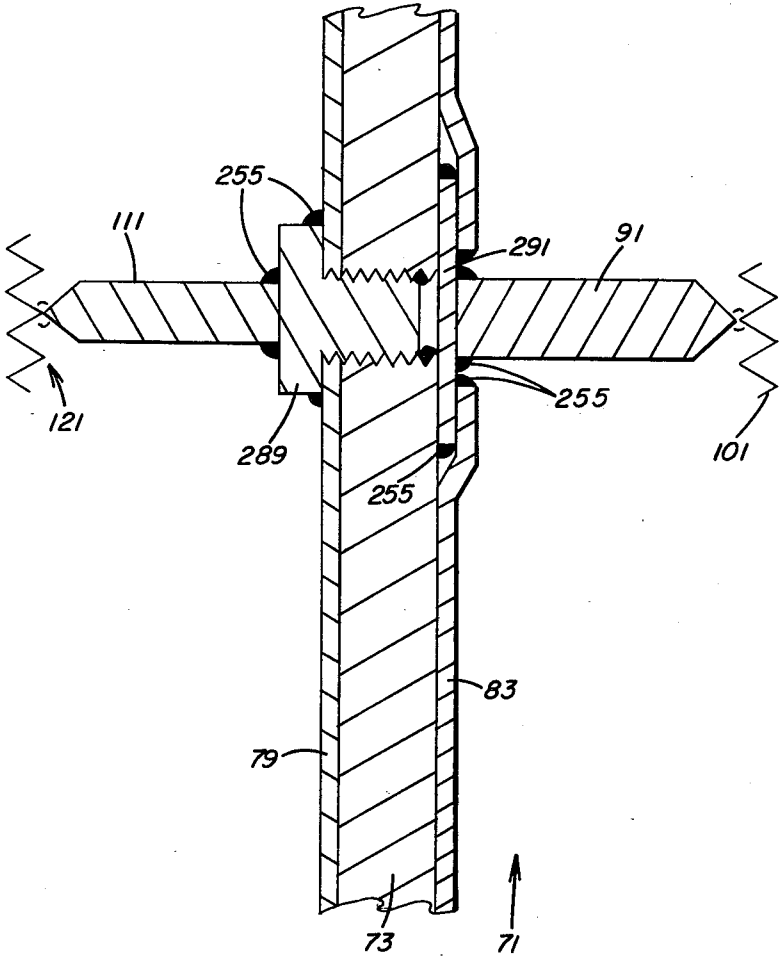

FIG. 22 is an element of a sectional plan view of bipolar element having a valve metal-transition metal bimetallic cladding as the barrier, with a threaded valve metal stud engaging a threaded aperture of the barrier.

Figure 23:
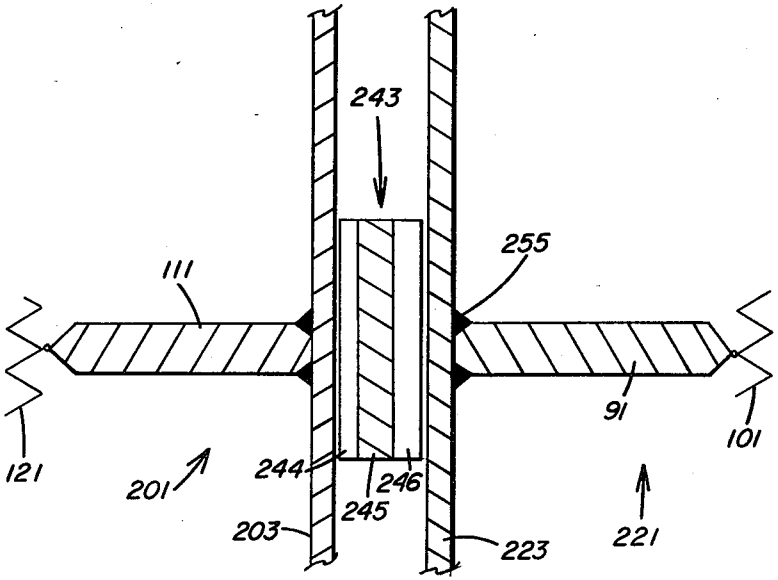

FIG. 23 is an element of a partially exploded sectional plan view of a bipolar element having the base of the anode compartment and the base of the cathode compartment connected by a trimetallic cladding of a transition metal member, a valve metal member, and a high conductivity metal member, e.g., a copper member, the valve metal member being bonded to the base of the anode compartment and the transition metal member being bonded to the base of the cathode compartment.

Figure 24:
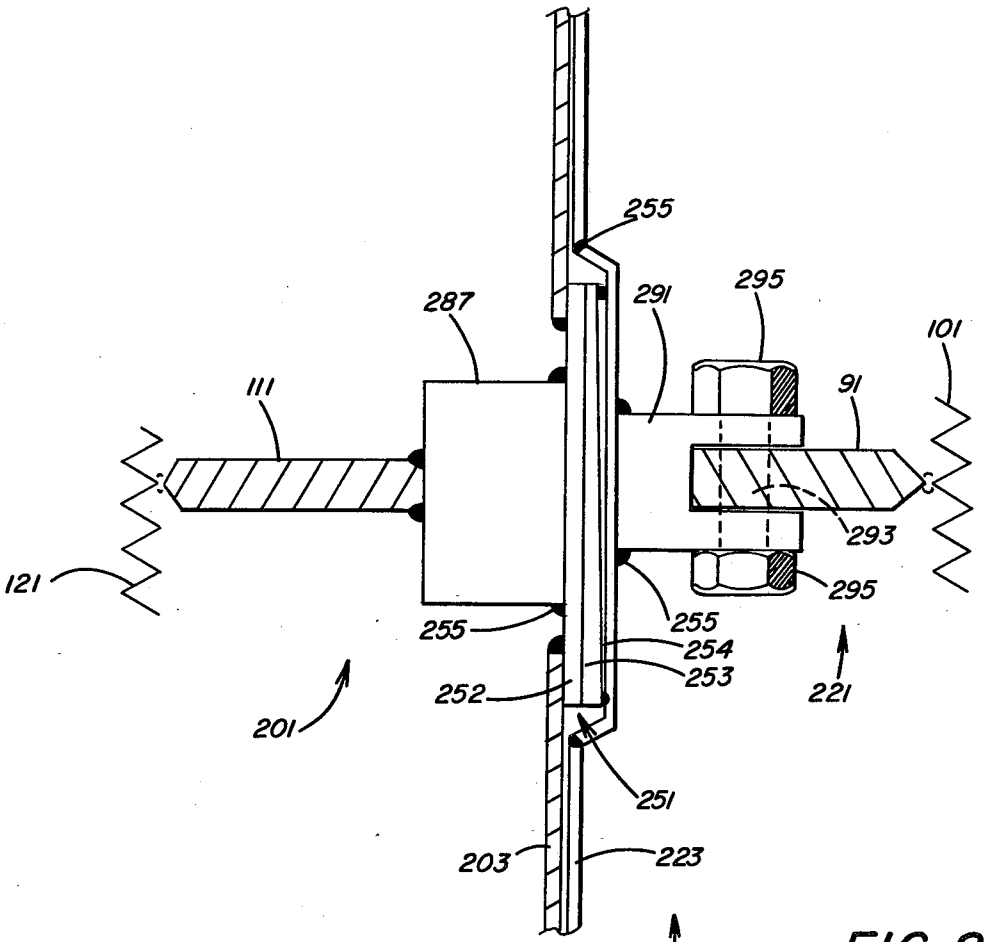

FIG. 24 is an element of a sectional plan view of a bipolar element having the base of the anode compartment joined to the base of the cathode compartment by bimetallic cladded element having one member of a high conductivity metal e.g., copper, and the other member of a valve metal, with the high conductivity metal bonded to the cathode base, and the valve metal member bonded to an aperture in the anode base.

Figure 25:
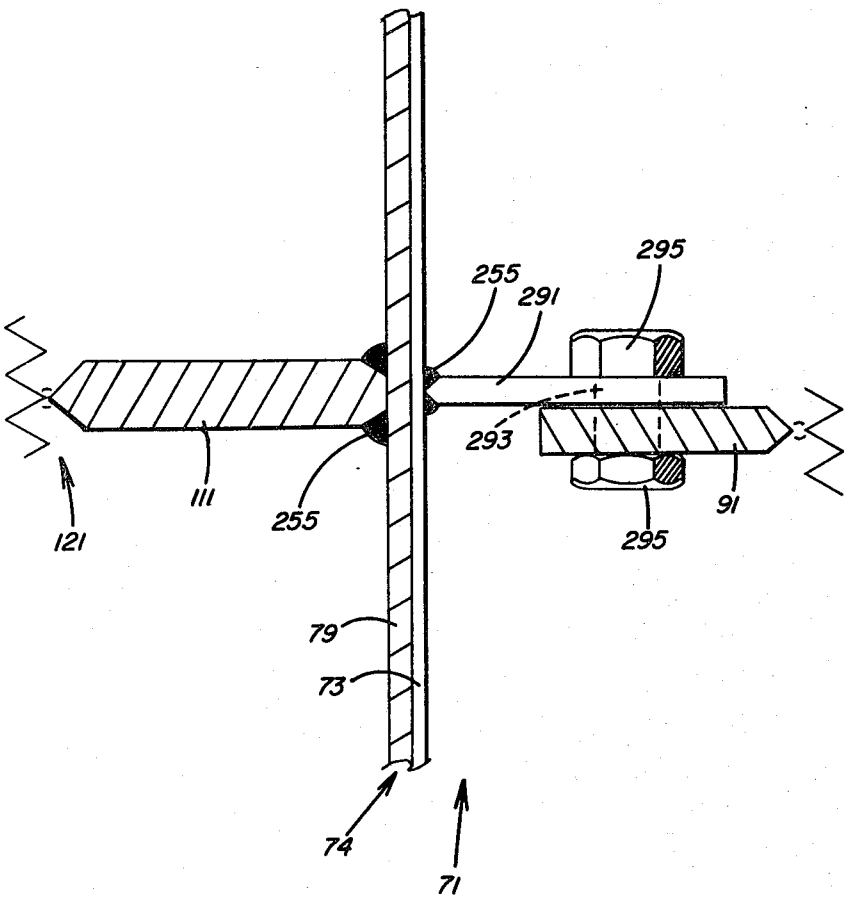

FIG. 25 is an element of a sectional plan view of a bipolar element having the barrier formed of a bimetallic cladding of a valve metal member and a high conductivity metal member, e.g., a copper member, with the electrode support bonded thereto.

Figure 26:
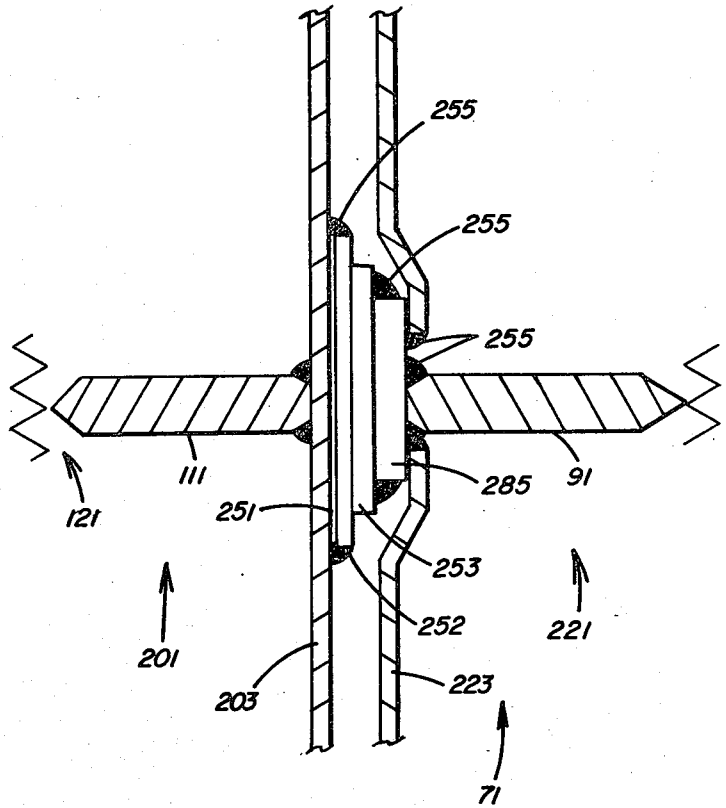

FIG. 26 is an element of a sectional plan view of a bipolar element having an anode base separated from a cathode base with a bimetal cladding of a valve metal and a transition metal therebetween. The valve metal portion of the cladding is bonded to the anode base and the transition metal member of the cladding is bonded to a transition metal plug or stud that is, in turn, bonded to the cathode base.

Figure 27:
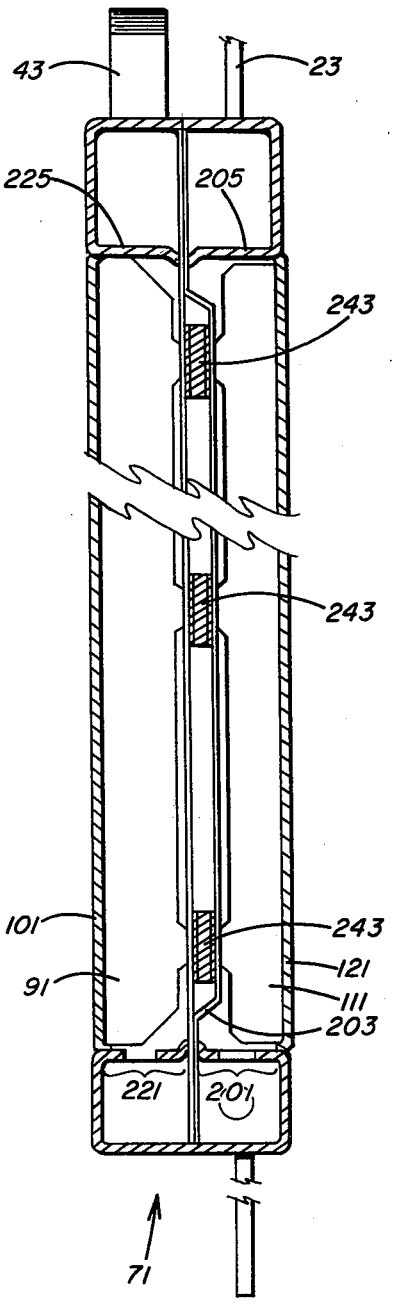

FIG. 27 is a sectional plan view of the bipolar element shown in FIG. 23 having a bipolar element formed of individual anode and cathode compartments with trimetallic elements therebetween.

Figure 4:
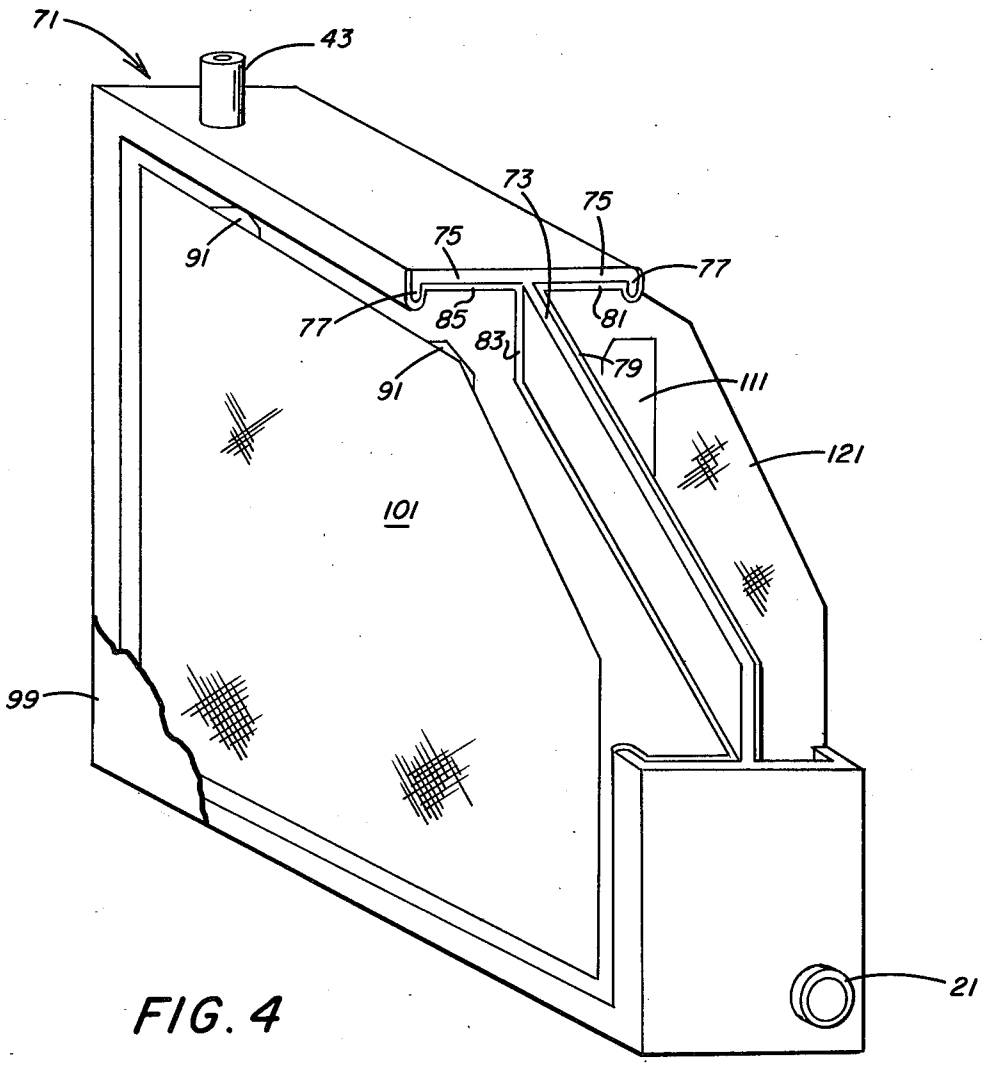
FIG. 4 is a partial cutaway of a bipolar element of the bipolar electrolyzer illustrated in FIGS. 1, 2, and 3.
Figure 28:
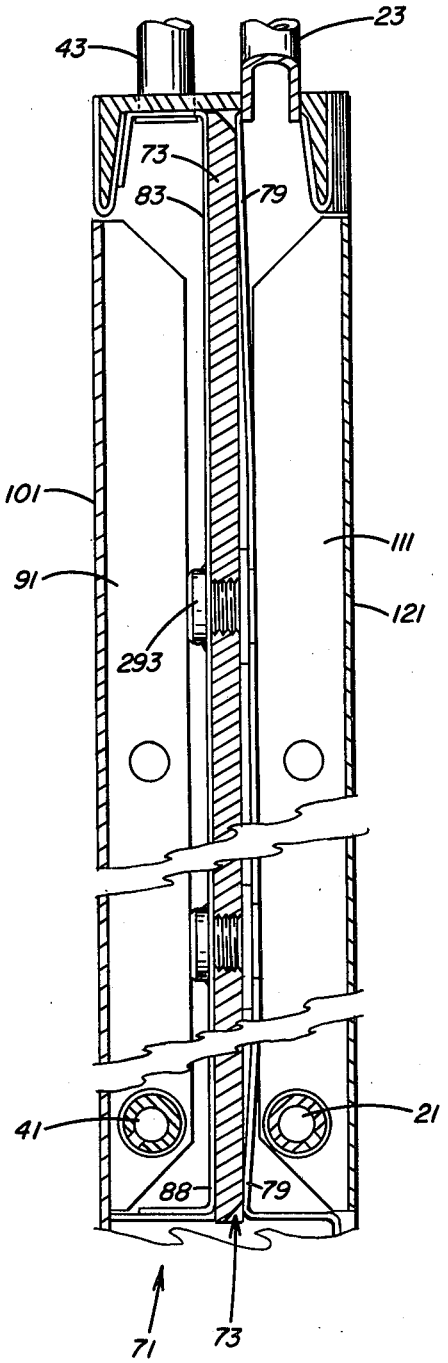

FIG. 28 is a sectional plan view the bipolar element shown in FIG. 4 having a metal partition with an anolyte resistant lining, a catholyte resistant lining, and current conducting means passing through the catholyte resistant lining to the partition.

Figure 29:
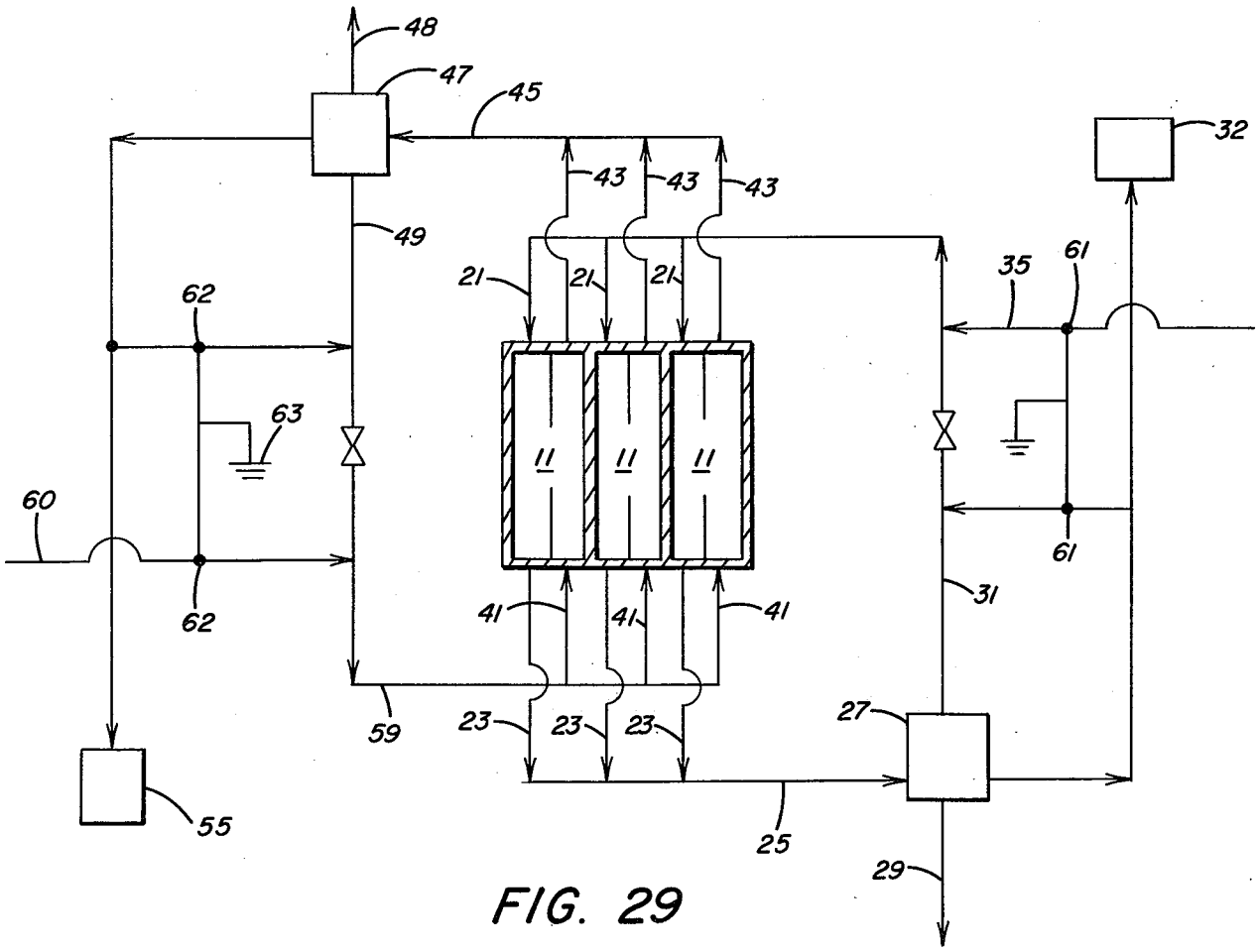

FIG. 29 is a schematic plan view of the electrolyzer electrolyte circulation system, including the electrolytic protection system therefor.

DETAILED DESCRIPTION OF THE INVENTION

A bipolar electrolyzer contains a plurality of individual electrolytic cells electrically and mechanically in series. Each individual electrolytic cell is made up of an anodic unit or member and a cathodic unit or member. The anodic unit or member of one individual electrolytic cell in the electrolyzer and the cathodic unit of the prior electrolytic cell in the electrolyzer form a bipolar element. The cathodic unit of a bipolar cell and the anodic unit of the next adjacent, subsequent bipolar cell also form a bipolar element, equivalently known as bipolar unit, or a bipolar electrode. In this way the cathodic element of a subsequent bipolar electrode and the anodic element of a prior bipolar electrode, adjacent to each other, form an individual electrolytic cell.

The bipolar element may be separate unitary members, i.e., containment vessels, sharing by a common conductor-connector element. Alternatively an individual bipolar element may have a common monolithic wall between the anodic and cathodic members thereof, for example with suitably resistant surfaces thereon, i.e., an anolyte resistant surface on the side in the anodic half cell, i.e., the anolyte compartment, of one cell and a catholyte resistant surface on the side in contact with the cathodic half cell, i.e., the catholyte compartment, of the adjacent cell.

The bipolar electrolyzer herein contemplated is further characterized by having planar anodes and planar cathodes. The planar electrodes are spaced from and parallel to the electrolyte compartment base, parallel to each other, and the anodes and cathode of an individual electrolytic cell are spaced from each other by the permionic membrane.

The electrodes are, in a preferred exemplification, in contact with the permionic membrane. As herein contemplated, with the electrodes contacting the permionic membrane, the electrodes may be in the form of non-catalytic current carriers in contact with electrocatalyst particles that are bonded to and embedded in a surface of the permionic membrane, for example a ruthenium dioxide-titanium dioxide coated titanium mesh or screen in contact with platinum black or platinized platinum particles embedded in and bonded to the anodic surface of the permionic membrance, or stainless steel mesh or screen in contact with platinized platinum or platinum black particles embedded in and bonded to the cathodic surface of the permionic membrane.

In an alternative exemplification the electrodes may comprise a porous, i.e., electrolyte and gas permeable, substrate, such as sheet, plate, screen, mesh, gauze, foil, or the like having electrocatalyst bonded and adherent thereto, the substrate bearing either on the permionic membrane or bearing on particles of a surface catalyst e.g., a surface modifier, as a bubble release agent, or of an electrical conductor adherent to the permionic membrance, the particles of the surface catalyst or electrical conductor being bonded to or embedded in the permionic membrane, or bearing on a porous film, layer, coating, laminate, or the like of a surface catalyst, hydrophilic material, or hydrophobic material.

According to a still further exemplification of this invention the one or both electrodes may be in form of porous sheet, plate, film, mesh, gauze, film, screen or the like, having a surface material of electrocatalyst adherent thereto. In this alternative exemplifcation the porous plate, sheet, screen, gauze, film, mesh or the like is in contact with suitable porous material, for example a porous, hydrophilic material or a porous hydrophobic material that is preferably adherent to the permionic membrane, as a film, coating, layer, or deposit.

As herein contemplated the porous electrode substrate is removably in contact with the permionic membrane. That is, it may be removed from contact with the permionic membrane during cell disassembly without damage to the electrode or the permionic membrane arising therefrom.

According to an alternative exemplification of the bipolar electrolyzer herein contemplated the electrode substrate may be spaced from the permionic membrane. While this is not normally necessary, i.e., because of the electrically insulating properties of the permionic membrane, to prevent direct shorting from anode to cathode, it may be necessary for other reasons to space one or both electrodes from the permionic membrane.

Figure 1:
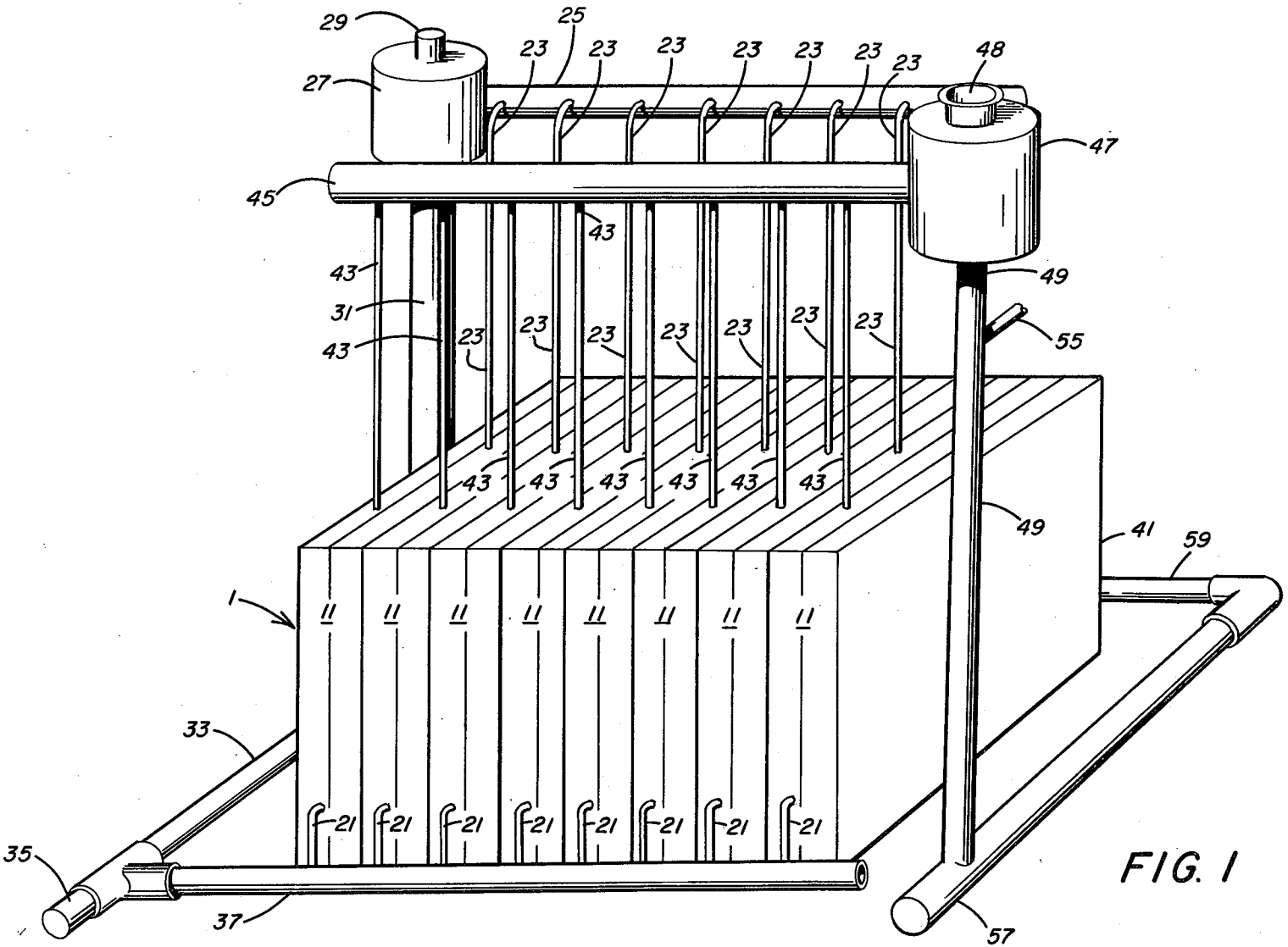
FIG. 1 is an isometric view of a bipolar electrolyzer.
Figure 2:
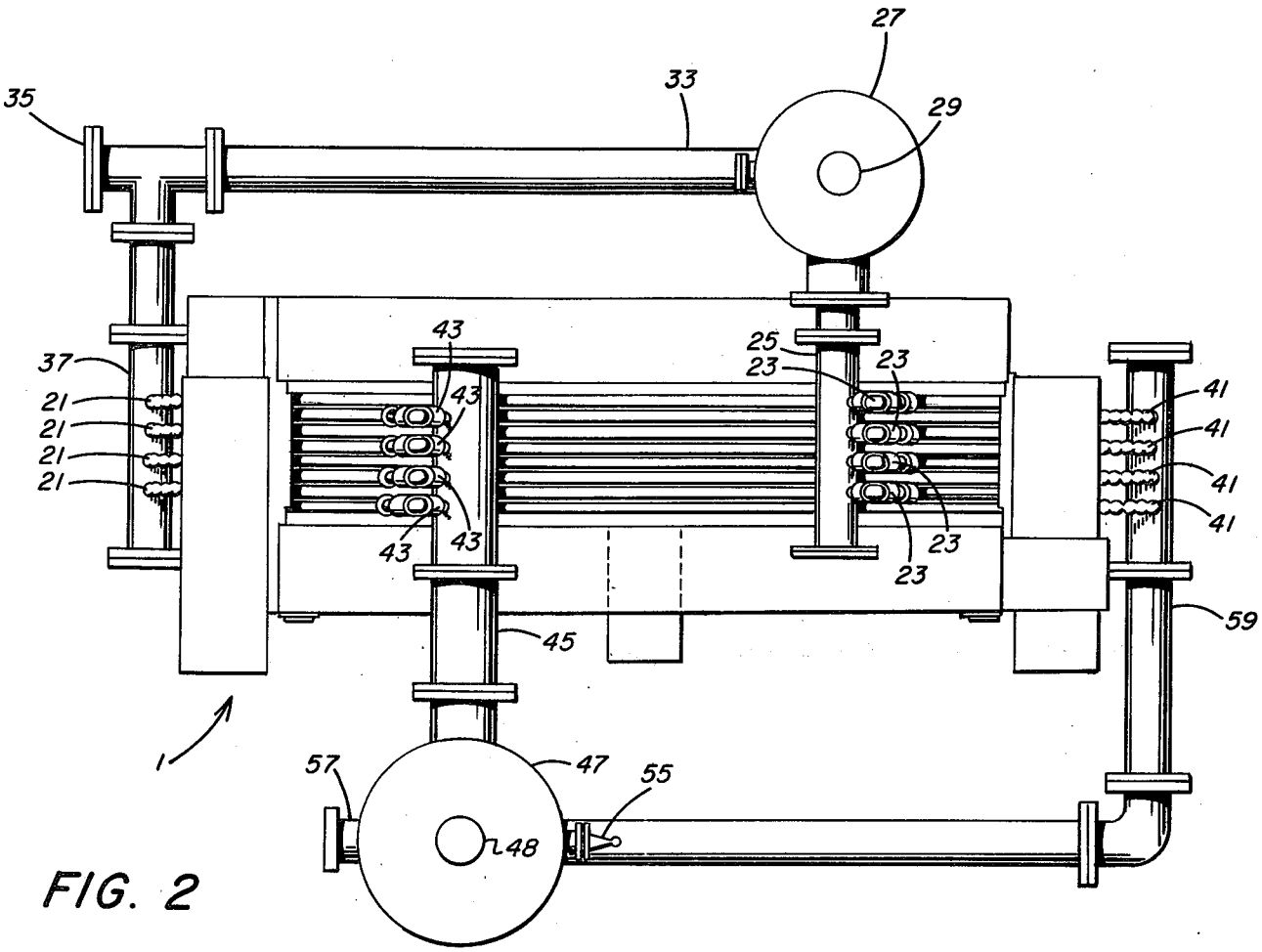
FIG. 2 is a plan view of the bipolar electrolyzer illustrated in FIG. 1.
Figure 3:
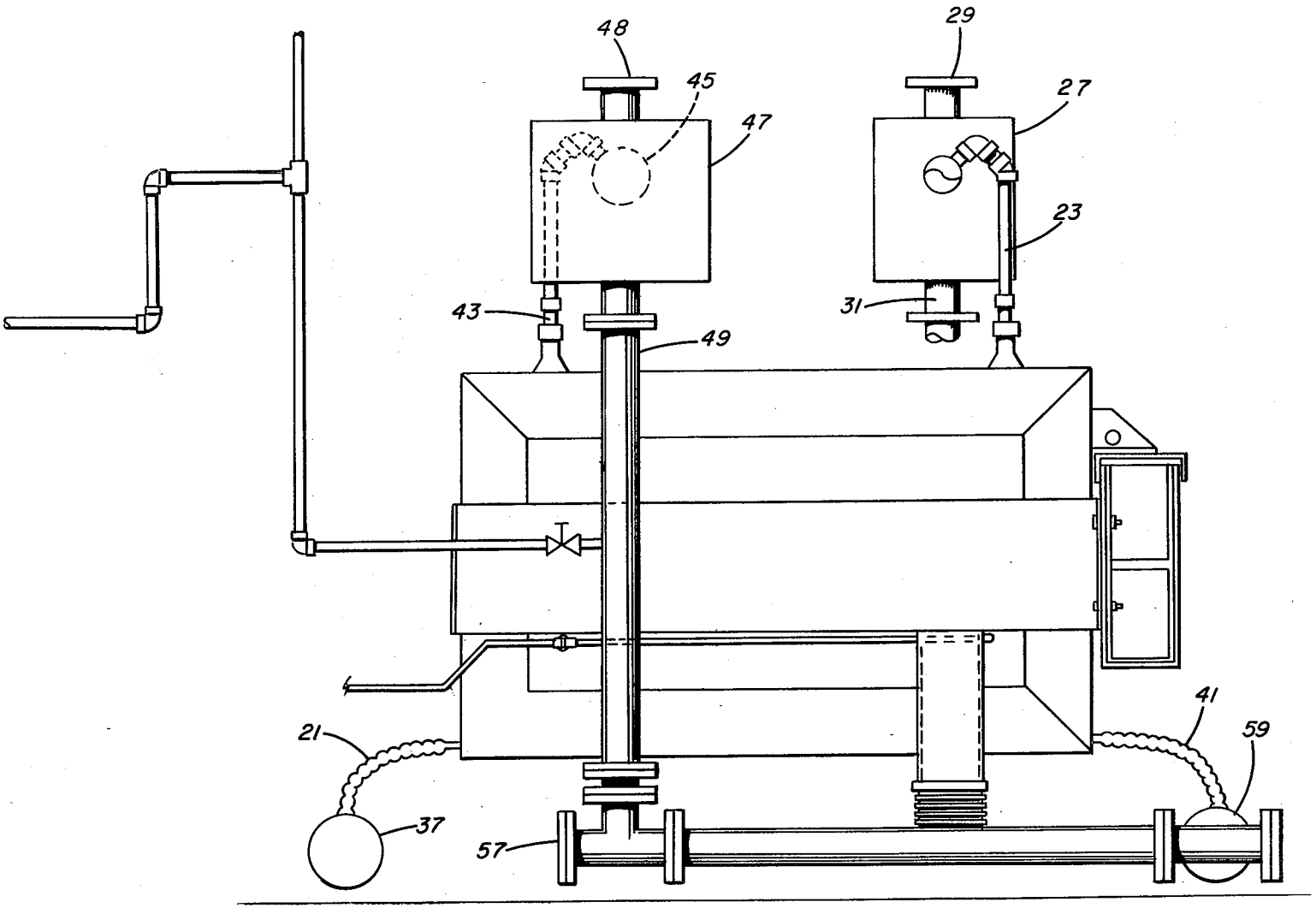
FIG. 3 is a front elevation of the bipolar electrolyzer illustrated in FIGS. 1 and 2.

FIGS. 1, 2, and 3 show a bipolar electrolyzer 1 having a plurality of individual electrolytic cells 11. The electrolytic cells 11 are electrically and mechanically in series and hydraulically in parallel. Brine, for example sodium chloride brine or potassium chloride brine or mixed sodium chloride brine and potassium chloride brine is fed to the anolyte compartments of the individual electrolytic cells 11 and water or dilute aqueous alkali metal hydroxide, e.g., sodium hydroxide or potassium hydroxide or a solution of sodium hydroxide and potassium hydroxide, is fed to the catholyte compartments of the individual electrolytic cells 11. Electrical current is imposed upon the electrolyzer 1 whereby to evolve chlorine at the anodes 121, hydroxyl ion in the catholyte liquor and hydrogen at the cathodes 101 with hydrogen gas and catholyte liquor rising through cathode risers 43. On the brine side of the circuit a froth of anolyte liquor and chlorine gas bubbles travel out of the individual anolyte compartments of the individual electrolytic cells 11 through individual risers 23.

The anolyte riser 23 and catholyte risers 43 are sized to provide for bubble flow wherein the bubbles of the gas, for example chlorine or hydrogen move along at about the same velocity as the liquid, e.g., sodium chloride in the anodic risers 23 and sodium hydroxide in the cathodic risers 43 or potassium chloride in the anodic riser 23 and potassium hydroxide in the cathodic riser 43, while avoiding both periodic waves of frothy slugs which move at a greater velocity than the average liquid velocity and alternating slugs of liquid and gas. In this way there is avoided pressure transients and oscillations, thereby keeping oscillatory, random, or transient component of the pressure drop across the permionic membrane under about one pound per square inch and preferably under about 0.10 pound per square inch.

The individual anolyte and chlorine risers 23 have a horizontal surface area normal to the direction of flow sufficient to provide a mass flow rate of electrolyte and gas therethrough of from about 50,000 to about 500,000 pounds per hour per square foot of riser area and preferably from about 100,000 to about 400,000 pounds per hour per square foot of riser area. A head of from about 10 to about 30 inches of anolyte liquor and preferably from about 12 to about 20 inches of anolyte liquor is maintained within the anolyte compartment and the gas-electrolyte froth within the anolyte compartment has a void fraction of about 10% to about 45% and preferably from about 15% to about 35%. The froth of anolyte liquor and chlorine is recovered through the risers 23 as a froth having a void fraction of about 65 to 95 percent, and is collected in a common header 25, which common header 25 is preferably substantially horizontal. Thereafter the froth is conducted via header 25 to a chlorine separator 29, for example a separation tank, a vortex separator, or a cyclone separator wherein the froth is separated into chlorine gas, which is recovered through outlet 29, and return anolyte liquor which is returned through downcomer 31. The return of anolyte liquor, for example from downcomer 31 and pipes 33 is mixed with concentrated brine, for example from feedline 35 and returned to te anolyte compartment through a header and individual feed lines 21 to the anolyte compartments of the individual electrolytic cells 11.

The amount of concentrated brine added to the return anolyte is from about one part of concentrated brine per part of return anolyte liquor to about one part of concentrated brine per twenty parts of return anolyte liquor and preferably from about one part of concentrated brine per three parts of return anolyte liquor to about ten parts of return anolyte liquor per part of concentrated brine.

On the cathodic side, a forth of catholyte liquor and hydrogen gas bubbles travel up through the individual riser 43 from the catholyte compartments of the individual electrolytic cells 11 to a common header 45. The forth of catholyte liquor and hydrogen gas is collected in the common header 45 which is substantially horizontal and transported via the common header 45 to the hydrogen separator 47, for example a separation tank, a vortex separator or cyclone separator. In the separator 47 the froth is separated into hydrogen gas which is recovered at outlet 48 and return catholyte liquor which passes through downcomer 49. The return catholyte liquor in downcomer 49 has a bleed stream removed therefrom, i.e., a bleed stream of alkali metal hydroxide product, which may recovered at collector 55. Make up electrolyte, e.g., water or dilute aqueous alkali metal hydroxide is added, for example at feed stream 57 and the resulting catholyte liquor and feed travels through header 59 to individual feed lines 41.

The amount of dilute caustic or water added to the return catholyte liquor is from about one part of water or dilute caustic per thirty parts of return catholyte liquor to about one part of dilute caustic or water per two hundred parts of return catholyte liquor and preferably from about one part of water or dilute caustic per forty parts of return catholyte liquor to about one part of water or dilute caustic per about eighty parts of return catholyte liquor.

Both recovery streams, i.e., the chlorine-anolyte liquor stream and the hydrogen-catholyte stream are operated so as to maintain pressure oscillations or transients across the permionic membrane below one pound per square inch and preferably below about 0.10 pound per square inch. The pressure across the permionic membrane, i.e., the head across the permionic membrane has two components, an average head which depends upon the physical and chemical parameters of the permionic membrane, caustic strength, and the anolyte composition, but is generally from about 0.10 to about 1.0 pound per square inch and a random, or transient component. When no attention is paid to the sizing of the piping, the range of the random, or transient component may be from minus one pound per square inch to plus one pound per square foot. The flow characteristics herein contemplated reduce the oscillatory or transient component to an average value of 0 and a range of extremes of up below 0.25 pounds per square inch and preferably less than one pound per square inch and particularly preferred less than 0.10 pounds per square inch.

It has been found that the random, transient, or oscillatory component can be reduced to a range of under one pound per square inch and preferably under 0.10 pound per square inch by sizing the risers 23 and 43 and the headers 25 and 45 so as to avoid waves that are picked up periodically in the form of a frothy slug and moved at a much greater velocity than the average liquid velocity, and also alternate plugs of liquid and gas moving along the pipe. Preferably, the flow in the risers 23 and 43 is characterized by bubbles of gas moving along at about the same velocity as the liquid therein. As herein contemplated, the desired bubble flow may be enhanced while slug flow and plug flow are substantially avoided by having the anolyte riser 23 and catholyte riser 43 sized so as to provide for a mass flow rate therethrough from about 50,000 to about 500,000 pounds per hour per square foot of riser area and preferably from about 100,000 to about 400,000 pounds per hour per square foot of riser area, a head of about 10 to 30 inches of water in the anolyte and preferably from about 12 to 20 inches of water therein, a head of from about 0 to about 40 inches of water on the catholyte side and preferably from about 10 to 30 inches, and a gas fraction of from about 10 to 45 percent on the anode side and preferably from about 15 to 35 percent therein and from about 3 to about 20 percent and preferably from about 3 to about 10 percent on the catholyte side. Moreover, as will be described more fully hereinbelow, with respect to control of stray electrical currents between adjacent electrolytic cells, the height of the risers in such as to avoid current flows between adjacent electrolytic cells.

FIG. 29 shows the electrolyte and gas systems in a particularly preferred electrical grounding system. The electrolyzer 1 with individual electrolytic cells 11 has a chlorine and brine side, as described above, with brine inlets 21 conveying brine to the individual cells 11, chlorine and anolyte risers 23 conveying a froth of chlorine and anolyte to header 25, and from the header to a separator 27 where chlorine gas is recovered from the separator at outlet 29 and an overflow 30 to a depleted brine tank 32, as well as a brine and anolyte liquor return line 31 and a concentrated brine line 35. Electrodes 61 are provided in contact with the brine. The anodes may be at various locations, for example at brine feed 35, or at the return downcomer 31. The electrodes are grounded 63. The electrodes are fabricated of a material that is resistant to acidic solutions, for example, the electrodes are fabricated of those materials that form a protective oxide film under acidic condition, i.e., the valve metals.

On the hydrogen-caustic side, there is a dilute cell liquor inlet 41 to the individual cells 11. A froth of hydrogen and alkali metal hydroxide is recovered through risers 43 which lead the froth to a common horizontal header 45. The common horizontal header 45 conveys the froth to a separator 47 where the froth is separated into hydrogen which is recovered at the gas recovery means 48, and to a catholyte liquor downcomer 49 for overflow of cell liquor and product recovery 55. Make up, i.e., water, or dilute caustic or caustic potash is added to the return catholyte liquor, i.e., the return cell liquor. Addition may be made at various locations, e.g., in or below the separator 47, or at feed point 60. The make up and return cell liquor return to the individual cells through return line 59 and individual feed inlets 41. Electrodes 62 are provided in contact with the return, e.g., at the overflow outlet 55 or make up feed 60 or even downcomer 49 or header 59. The individual electrodes 62 are grounded 63. Typically the electrodes 62 are a material that is electrically conductive, and resistant to the alkaline cell liquid, e.g. iron, steel, stainless steel, nickel and the like.

The electrolyte spacing between adjacent cells, that is the liquid path from the anolyte compartment of an electrolytic cell 11 through riser 23 to header 25 hence to the adjacent riser 23 and through the adjacent riser 23 to the anolyte compartment of the adjacent cell 11, i.e., from the anolyte of one adjacent cell to the anolyte of the next adjacent cell, and from the catholyte of an electrolytic cell through hydrogen riser 43 to header 45 and from header 45 to riser 43 of the next adjacent cell, i.e., from catholyte of an electrolytic cell 11 to the catholyte of the next adjacent electrolytic cell 11 is such as to avoid stray currents.

The space from the permionic membrane 99 to the partition 73 in the back of the electrolyte compartment, i.e., to the back 79 of the anolyte compartment or to the back 83 of the catholyte compartment is such as to enhance gas lift, and high void volume in the electrolyte. Preferably, the spacing is narrow enough to allow the liquid entering through the electrolyte feed, 21, 41, at the bottom of the compartments to have the velocity thereof enhanced by the gas lift of the evolved gases, forming a froth which froth is carried to the risers 23, 43 at the top opposite side by the gas lift, providing a gas void volume of 10 to 45 percent and preferably from about 15 to 35 percent, a gas void volume of 75 to 95 percent in the risers, a gas lift velocity sufficient to provide rapid recirculation through the system described above, and a gas lift velocity sufficient to provide good mixing.

Generally the space from the permionic membrane 99 to the back 73 of the electrolyte compartment is such as to provide a current flow per unit electrolyte volume in excess of 1200 amperes per cubic foot of electrolyte volume and preferably above about 1500 amperes per cubic foot of electrolyte volume. As used herein the electrolyte volume is only anolyte compartment volume or is only catholyte compartment volume taken individually. In a particularly preferred exemplification the current per unit electrolyte volume is above about 2500 amperes per cubic foot of electrolyte volume per compartment, and the current density is from 150 to 600 amperes per square foot.

Turning now to the cell structure shown in FIGS. 1, 2, 3, and 4 it is seen that a bipolar electrolyzer 1 has a plurality of individual bipolar elements 71 electrically in series, with each of the bipolar elements 71 having a cathodic first compartent and an anodic second compartment, and a partition 73 therebetween. In one exemplification the partition 71 is a metal partition with electrolyte resistant properties. In an alternative exemplification two metal partitions are present, one functioning as the base of the anolyte compartment and the other functioning as the base of the catholyte compartment. A peripheral wall 75 is provided, supported by and perpendicular to the compartment bases or partition 73 and surrounding the cathodic first compartment and the anodic second compartment.

The cathodic first compartment has a surface exposed to the catholyte liquor that is substantially chemically resistant to the effects of catholyte liquor. According to one exemplification the cathodic first compartment may have liner means 83 on the cathodic surface of the peripheral wall 75, the liner means 83 being substantially resistant to aqueous alkali metal hydroxide. Typically the liner is fabricated of an alkali resistant metal, e.g., iron, steel, stainless steel, nickel, or copper. Alternatively it may be fabricated of an alkali resistant polymer, e.g., polypropylene polyvinyl chloride chloronated polyvinyl chloride, chlorofluorocarbons, or thermoplastic fluorocarbons.

The cathodic first compartment further has cathode support means 91 extending substantially perpendicularly outward from and electrically in contact with the base 223 or metal partition 73. Cathode means 101, as described above, are bonded to the cathode support means 91 and are parallel to and spaced from, the metal partition 73 or base 223 of the cathode compartment.

The cathode means 101 are substantially planar and permeable to electrolyte and gases.

The anodic, second compartment has the surfaces thereof exposed to anolyte liquor fabricated of the material that is substantially chemically resistant to chlorinated, aqueous alkali metal chloride and to chlorine gas. This may be provided by having liner means 79, 81 on the anodic surface of the partition 74, and the interior anodic surface of the peripheral wall 75.

The anodic second compartment 201 contains anodic support means 111 extending substantially perpendicularly outward from and electrically in contact with the base 203 of the anolyte compartment 201, or with the metal partition 74.

Anode means 121, as described above, are bonded to anode support means 111 and are parallel to and spaced from the base 203 of the anode compartment 201 or the metal partition 73. The anode means 121 comprise an electrolyte and gas permeable, electroconductive substrate with an electrocatalytic coating thereon in a preferred exemplification.

Each of the cathode support means 91 correspond to an anode support means 101, with a pair of said cathode support means 91 and the corresponding anode support means 101 being electrically in series and mechanically in series at a conductor element with means resistant to the flow of hydrogen therebetween.

The anodic compartment of one bipolar element and a cathodic compartment of the next adjacent bipolar element form an electrolytic cell 11. The anodic and cathodic compartments are separated by a permionic membrane 99, with anode means 121 contacting one surface of the permionic membrane 99, and cathode means 101 contacting the opposite surface of the permionic membrane 99.

In the exemplification shown in FIG. 4 the cathode support means 91 comprise a plurality of substantially vertical resilient metal sheets parallel to each other and substantially perpendicular to the cathode means 101 and the partition 73 or base 223 of the catholyte compartment. The sheets 91 contact either conductor elements or the base 223 of the catholyte compartment, and may be spaced from the partition, 73 or base 223 between points of contact. This is, means may be provided between the points of contact to allow for the flow of electrolyte. Alternatively or additionally, the sheets may contact the cathode means at bonds therewith, and be spaced therefrom between the bonds, i.e., to allow for the flow of electrolyte transverse to the plane of the electrode. Additionally, or alternatively, perforations or openings may be provided in the sheets 91 at various places whereby to allow for the transverse or lateral flow of electrolyte.

In the exemplification shown in FIG. 4 the anode support means 111 comprise a plurality of substantially vertical, resilient metal sheets 111. The sheets 111 are parallel to each other and substantially perpendicular to the anode means 121 and to the partition 73. The sheets 111 may have points of contact with the partition 73 and be spaced therefrom between points of contact. In this way, openings are provided to allow the electrolyte i.e., the froth of gas and electrolyte, to move transversely to the plane of the anodes 121.

While the sheets 111 may contact the anode means 121 at the points of contact therewith, they may be spaced therefrom between the points of contact, i.e., between the welds or joints. In this way, flow of electrolyte transverse to the plane of the anode means 121 is provided for. Alternatively, or additionally, there may be perforations or openings or apertures in the sheets 111 whereby to allow for the flow of electrolyte transverse to the plane of the anode means 121.

As herein contemplated, the anode support means 111 of one bipolar element 71 may be laterally offset from the cathode support means 91 of the next adjacent bipolar element 71. In this way, the anode means 121, the cathode means 101, and the permionic membrane 99 therebetween in an individual electrolytic cell 11 have a uniform deformation, e.g., a sinusoidal deformation, and a substantially uniform thickness or compression.

According to an alternative exemplification, the anode support means 111 of one bipolar element 71 are opposed to the cathode support means 91 of the next adjacent bipolar element 11 whereby the anode means 121, the cathode means 101 and the permionic membrane 99 therebetween in an individual electrolytic cell 11 are compressively deformed.

Figure 5:
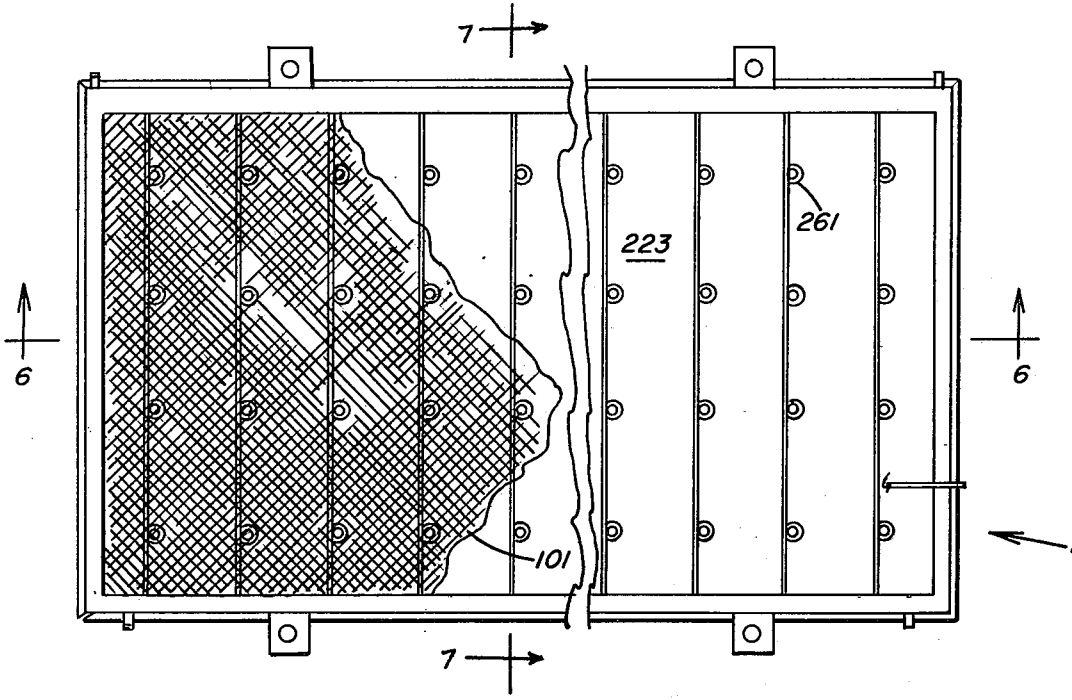
FIG. 5 is a front elevation of the bipolar element illustrated in FIG. 4.
Figure 6:
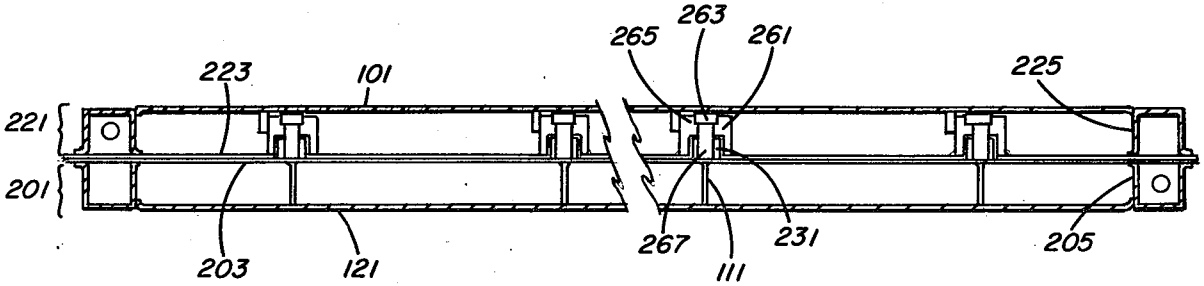
FIG. 6 is a sectional plan view along plane 6—6 of the bipolar element illustrated in FIGS. 4 and 5.

According to an alternative exemplification, shown, e.g., in FIGS. 5 and 6, therein provided a bipolar electrolyzer having a plurality of individual bipolar elements 71 electrically in series. Each of the bipolar elements 71 comprise a cathodic first compartment 221 having a base 223, peripheral walls 225 and cathode means 101, and an anodic second compartment 201 having a base 203, peripheral walls 205 and anode means 121. The anodic compartment 201 and the cathodic compartment 221 are arrayed in base 203-to-base 223 configuration and electrically and mechanically in series with electrical conductor means interposed between the anodic base 203 and the cathodic base 223.

The cathodic first compartment 221 has cathode support means 91 which extend substantially perpendicularly from the base 223 of the cathodic first compartment 221.

The cathode means 101 as described hereinabove are bonded to the cathode support means 91. The cathode means 101 are planar, substantially parallel to and spaced from the base 223 of the cathode compartment 221, permeable to electrolyte and gases.

The anodic second compartment 201 of the bipolar element 71 has anode support means 111 which extend substantially perpendicularly outward from the base 203 of the anodic second compartment 201 of the bipolar element 71. Anode means 121 of an electrolyte and gas permeable electroconductive substrate with an electrocatalytic coating thereon, as described hereinabove, are bonded to the anode support means 111, parallel to and spaced from the base 203 of the anode compartment 201.

Electrical conductor means pass from cathode support means 91 through the base 223 of the cathodic first compartment 221 and through the base 203 of the anodic second compartment 201 to a corresponding anode support means 111. In this way, electrical current is conducted from the cathode compartment 221 of the bipolar element 71 to the anode compartment 201 of the bipolar element 71, with a structure providing high electrical conductivity and high resistance to the permeability of nascent hydrogen, from the cathode 101 to the valve metal of the anode support means 111.

The anodic compartment 201 of one bipolar element 71 and the cathodic compartment 221 of the next adjacent bipolar element 71 form an individual electrolytic cell 11. The anodic 201 and cathodic 201 compartments of the bipolar elements 71 are separated by a permionic membrane 99. As described hereinabove, the anode means 121 contact one surface of the permionic membrane 99 and the cathode means 101 contact the opposite surface of the perionic membrane.

The cathode support means 91 comprise a plurality of substantially vertical metal sheets which are parallel to each other and substantially perpendicular to both the cathode means 101 and to the base of the cathode compartment.

Figure 7:
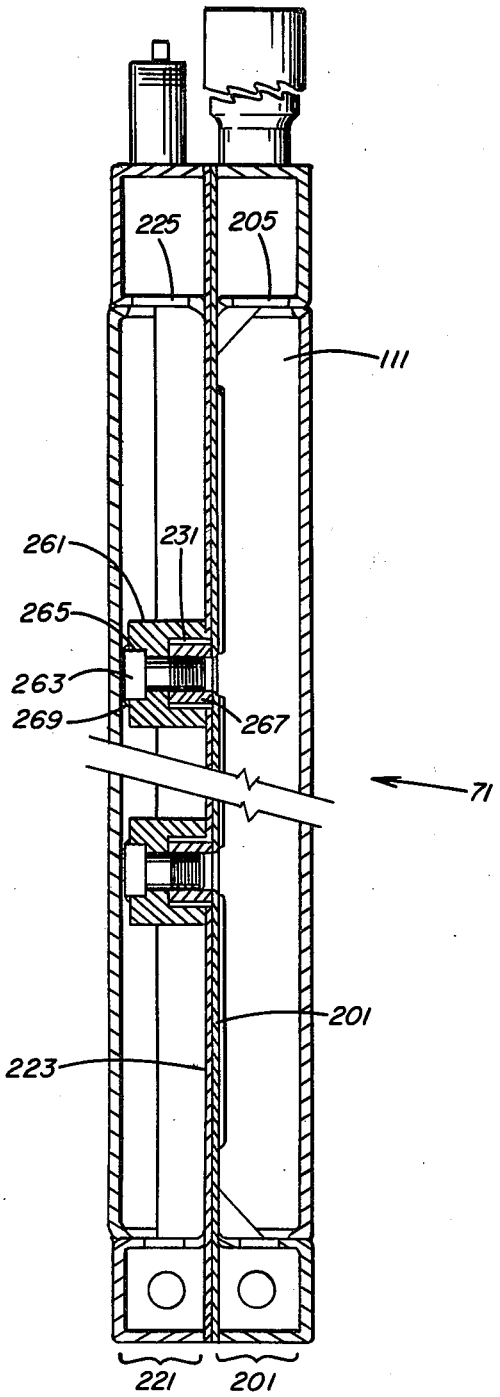
FIG. 7 is a sectional plan view along cutting plane 7—7 of the bipolar element shown in FIGS. 4, 5, and 6.

In the exemplification shown in FIGS. 5, 6 and 7, where the bipolar element has a cathodic first compartment 221 and an anodic second compartment 201 electrically in series with an electrical conductor means therebetween. The electrical conductor means comprises a hollow metal cylinder 261 welded to the cathodic facing side of the cathode base member 223 around an aperture therein, and having an apertured top remote from the cathode base member 223. A hollow, internally threaded nut 267 is welded to the cathode facing side of the anodic base member 203 and passes through the hollow metal cylinder 261, i.e., it is concentrically arrayed within the hollow metal cylinder 261. A bolt 263 passes through the cylinder 261 and has a head compressively bearing upon the apertured top of the hollow metal cylinder 261, threadably engaging the nut 267 welded to the cathodic facing surface of the anodic base member 203. In this way, the conductor means do not necessarily have to pass through the base member 203 of the anodic compartment 201.

The hollow metal cylinder 261 is fabricated of the metal that is resistant to concentrated alkali solutions under cathodic solutions. Typically it is fabricated of the same material as the cathode compartment.

The bolt head may be seal welded to the apertured top of the hollow steel cylinder 261 and the cathode support means 91 may be welded to the hollow steel cylinder 261.

Figure 8:
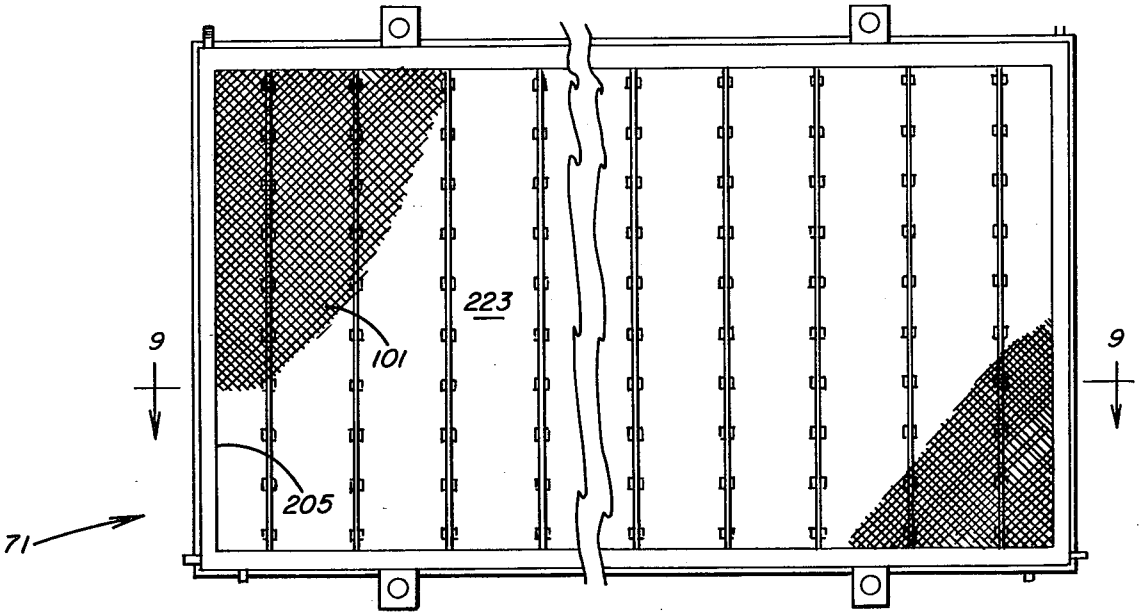
FIG. 8 is a plan sectional view of an alternative bipolar element.
Figure 9:
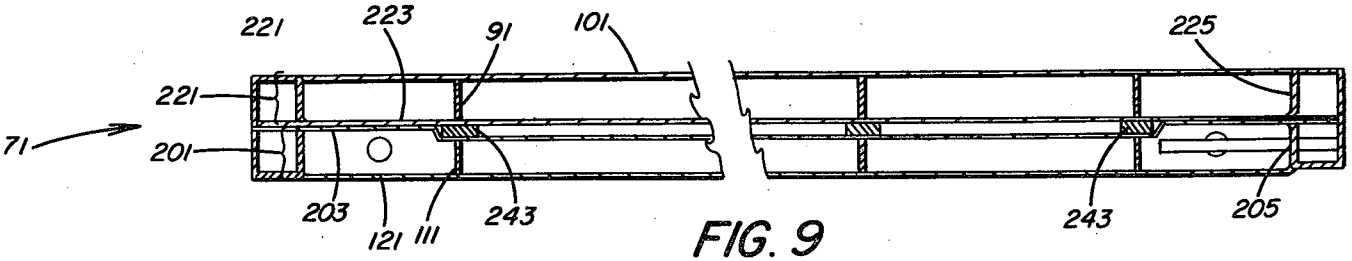
FIG. 9 is a side elevation sectional view of the bipolar element shown in FIG. 8.

A further exemplification of the embodiment of this invention where the bipolar element comprises an anodic compartment 201 and a cathodic compartment 263 arrayed in base-to-base configuration and electrically and mechanically in series with electrical conductor means therebetween, is in FIGS. 8, 9, and 23. As there shown, a trimetallic stud 243 may be provided between the base 203 of the anodic compartment 201 and the base 223 of the cathodic compartment 223. The trimetallic stud comprises a transition metal member 246, a valve metal member 244, and a member 245 of high electrical conductivity and low hydrogen permeability, e.g., a copper or silver member. The transition metal member 246 is welded or otherwise joined to the base 223 of the cathode compartment 221. The valve metal member 224, i.e., the titanium or tantalum member is welded or otherwise bonded to the base 203 of the anodic compartment 201. The member 245 of low hydrogen permeability, i.e., the silver or copper member, is interposed between and bonded to the transition metal member 246 and the titanium member 244.

According to one particularly preferred exemplification, the low hydrogen permeability, high electroconductivity member 245 is suitably bonded, e.g., detonation clad, diffusion welded, friction welded, or Sun-2-R welded to either or both the valve metal member 244 and the transition metal member 246. In a particularly preferred exemplification, the low hydrogen permeability, highly electrically conductive member, is a copper member.

Figure 10:
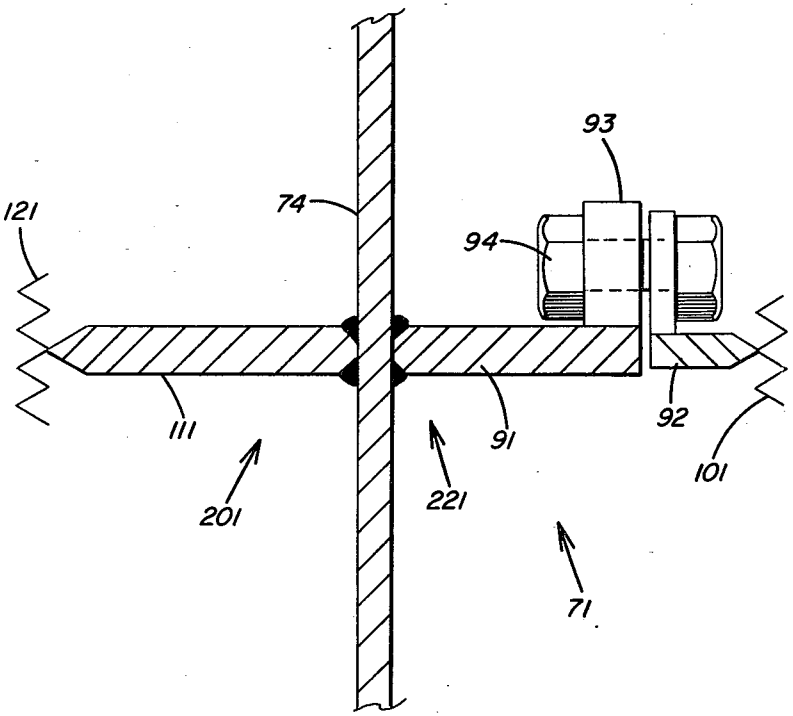
FIG. 10 is an element of a sectional plan view of a bipolar element having a partition of an alloy of titanium and a rare earth metal.

In an alternative exemplification of this invention, shown in FIG. 10, there is provided a bipolar electrolyzer having a plurality of individual bipolar elements electrically in series. Each of the bipolar elements comprises a first, cathodic compartment 221, and anodic, second compartment 201, and a metal partition 74 therebetween. As herein contemplated, the metal partition is an alloy consisting essentially of titanium and a hydride formation inhibiting amount of yttrium, i.e., from about 0.01 to about 1.0 weight percent yttrium, as described in U.S. Pat. No. 4,075,070 to DuBois et al for *Electrode Material* and U.S. Pat. No. 4,133,730 to DuBois et al for *Electrolysis of Brine Using Titanium Alloy Electrode.*

As described hereinabove, the cathodic side of the bipolar element 71 has cathode support means 91 extending perpendicularly outward from, bonded to, and electrically in contact with the titanium-yttrium alloy metal partition 74. The cathode means 101 are bonded to the cathode support means 91 and are substantially paralled to, and spaced from the metal position. The cathode means 101 are substantially planar, and permeable to electrolyte and gases.

The anodic side of the bipolar element 71 has anode support means 111 extending substantially perpendicularly outward from, bonded to, and electrically in contact with the metal partition 74. Anode means 121 are bonded to the anode support means 111, parallel to, and spaced from the metal partition 74. The anode means comprise, as described herein, an electrolyte and gas permeable electroconductive substrate, with a suitable electrocatalytic coating thereon.

As contemplated in an alternative exemplification the cathode 101 is bonded to an intermediate cathode support means 92 that is, in turn, removably joined to the cathode support means 91. This may be accomplished by bolting the removable cathode support means 92 to the cathode support means 91, e.g. at extension 93 with bolt means 94.

Figure 11:
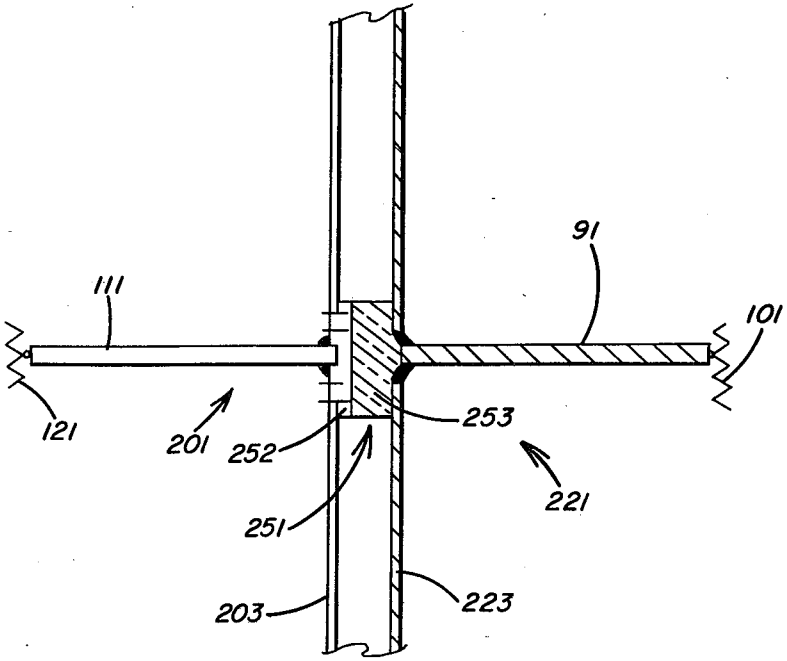
FIG. 11 is an element of a sectional plan view of a bipolar element having a valve metal base for the anode compartment, a transition metal base for the cathode compartment and a bimetallic cladding of a conductive metal and a valve metal therebetween.

According to an alternative exemplification of the embodiment of this invention, where the anodic unit 201 and the cathodic unit 221 are arrayed in base 203 to base 223 configuration, shown in FIG. 11, the biopolar element 71 comprises an anodic compartment 201, a cathodic compartment 221, and connector conductor means therebetween. The connector-conductor means is bimetallic stud 251. The stud 251 contains an electrically conductive, hydrogen resistant metal member 253 bonded to the base 223 of the cathodic compartment and a valve metal member 252 bonded to the base 203 of the anodic compartment 201. The electrically conductive, hydrogen diffusion resistant member 253 may be a silver member or copper member. Preferably it is a copper member. The valve metal member 252 may be a titanium member or tantalum member. Preferably it is a titanium member.

The valve metal member 252 of the bimetallic stud 251 is welded or otherwise bonded to the exterior surface of the base 203 of the anodic compartment 201. The high electrical conductivity, hydrogen diffusion resistant member 253 of the bimetallic element 251 is bonded or otherwise welded to the external surface of the base 223 of the cathodic compartment 221.

According to a still further exemplification, shown with specificity in FIG. 11 the base 223 of the cathodic compartment 221 may have apertures therein, with the high conductivity member 253 of the bimetallic stud 251 welded to the base 223 of the cathode member 221 and the cathode support means 91 passing through the aperture and being welded or otherwise bonded to high conductivity member 253 of the bimetallic stud 251.

Figure 15:
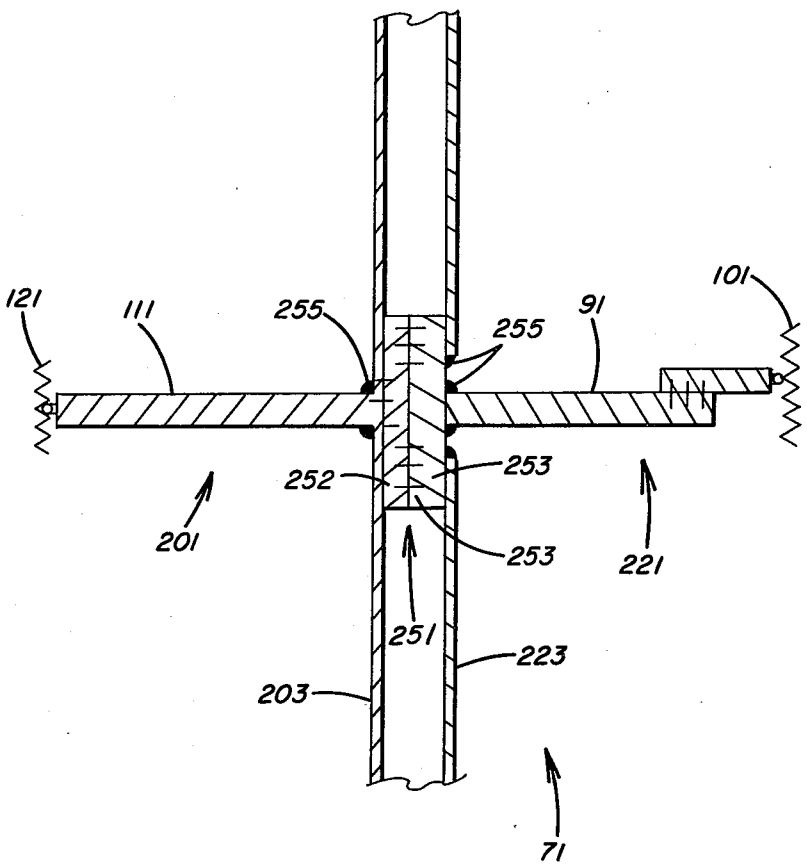
FIG. 15 is an element of a sectional plan view of a bipolar element having a valve metal base for the anodic compartment, a transition metal base for the cathodic compartment, and a welded valve metal-conductive metal element therebetween, with the cathode support extending outward therefrom.

According to a still further exemplification shown in FIG. 15, the cathode support member 91 may be the same material as the electrically conductive, hydrogen diffusion resistant member 253 of the bimetallic stud, i.e., silver or copper.

Figure 12:
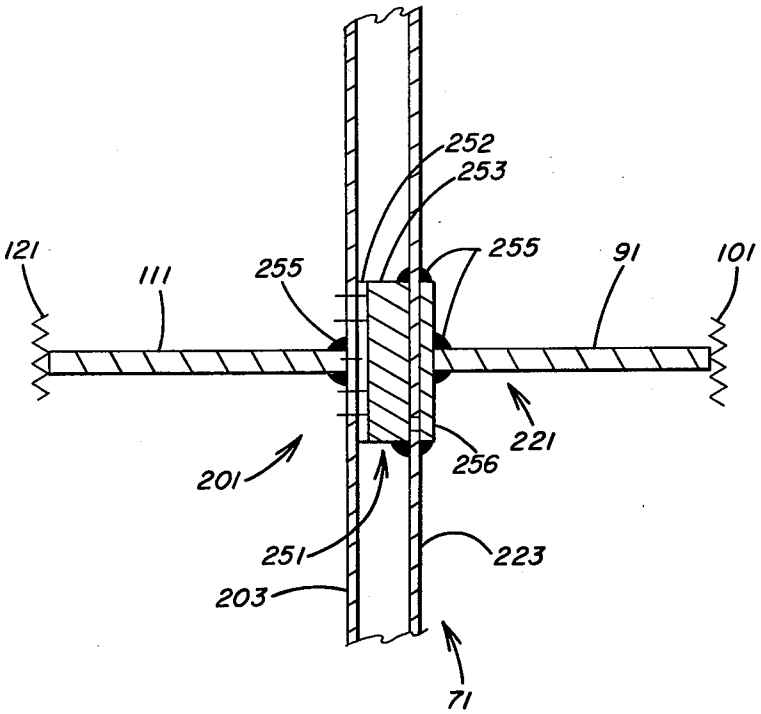
FIG. 12 is an element of a sectional plan view of a bipolar element having a valve metal base for the anode compartment, a transition metal base for the cathode compartment, a bimetallic cladding of a conductive metal and a valve metal, and means for venting hydrogen trapped between the conductive metal and the transition metal base of the cathodic element.

According to an alternative exemplification shown in FIG. 12 the bimetallic stud 251, fabricated of a highly conductive metal element 253, and a valve metal element 252, with the valve metal member or element 252 welded to the anode conductor means 111, and the conductive metal member or element 253 welded to the cathode conductor means.

The base 223 of the cathode compartment 221 may be provided with a bimetallic stud 251 and a plate 256. The high conductivity element 253 of the bimetallic stud 251 welded to the base 223 of the cathode compartment 221, the plate 256 is welded to the opposite side of the base 223, and the cathode support means 91 is welded to the opposite side of the plate 256. Hydrogen vent means e.g., an aperture, space, or conduit, may be provided between the plate 253 and the bimetallic element 251.

Figure 13:
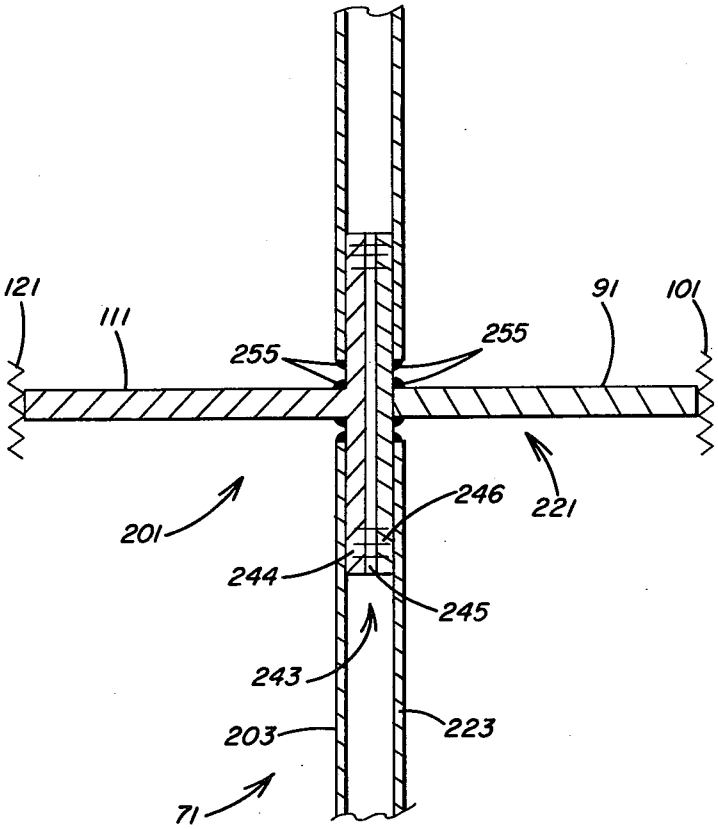
FIG. 13 is an element of a sectional plan view of a bipolar element having a valve metal base for the anode compartment, a transition metal base for the cathode compartment, and a bimetallic cladding of a conductive metal and a valve metal therebetween.

According to an exemplification of this invention when the base 203 of the anodic compartment 201 and the base 223 of the cathodic compartment 231 are arrayed in base to base configuration, shown in FIG. 13, there is provided a bipolar element having an anodic compartment, 201 a cathodic compartment 221, and electrical conductor means 243 between the bases 203, 223 thereof. As shown in the Figure, the transition metal member 246 of the trimetallic element 243 is welded to the back surface of the base 223 of the cathode compartment 221 at an aperture therein. The cathode support means 91 extend through the aperture and are bonded to the valve metal member 244 of the electrical conductor means 243.

According to an alternative exemplification of the embodiment shown in FIG. 13, the valve metal member 244 of the trimetallic element 243 may be bonded to the anode base 203 at an aperture therein, and the anode support means 111 may pass through the aperture and be bonded to the valve metal member 244 of the trimetallic element 243. According to a particularly preferred exemplification, the valve metal member 244 of the trimetallic element 243 is welded to the anode support means 111.

Figure 14:
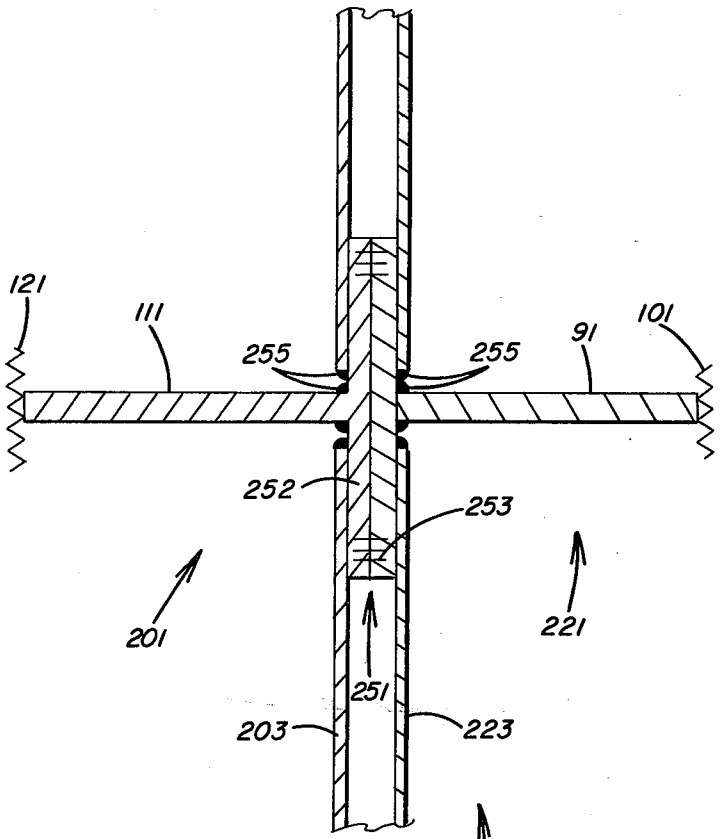
FIG. 14 is an element of a sectional plan view of a bipolar element having a valve metal base for the anodic compartment, a transition metal base for the cathodic compartment, and a welded transition metal-valve metal element therebetween.

According to an alternative exemplification shown in FIG. 14, the valve metal member 252 of the bimetallic element 251 and the other member 253 of the bimetallic element 251 may be electron beam welded.

According to a still further exemplification of the structure of this invention, a bimetallic element may be substituted for the trimetallic element, with a metal plate being welded to the base 223 of the cathodic member 221, and the bimetallic element being welded to the metal plate.

Figure 16:
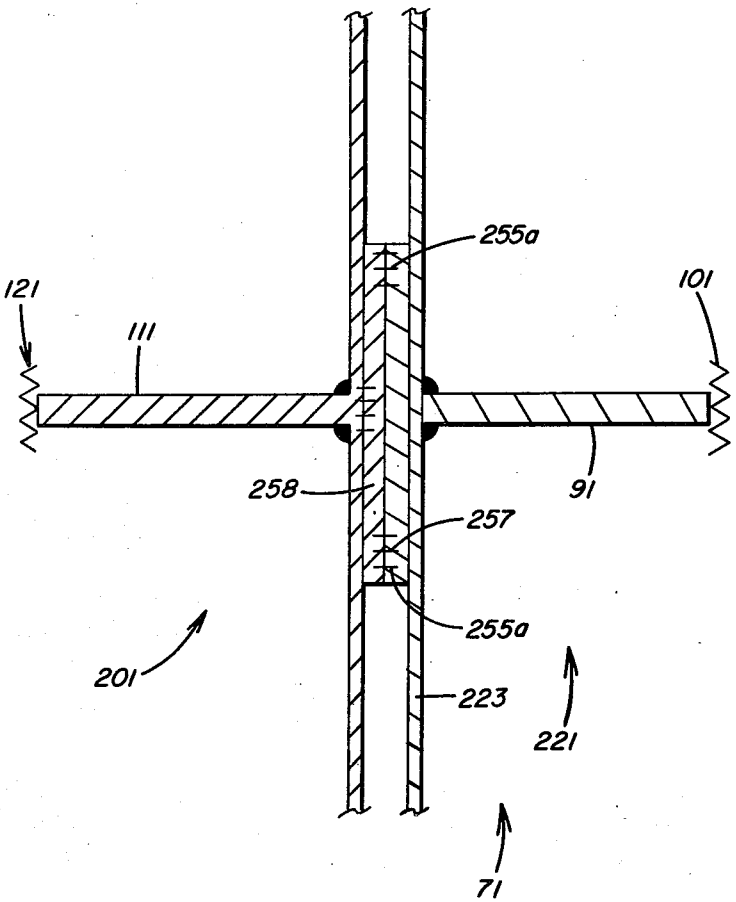
FIG. 16 is an element of a sectional plan view of a bipolar element having a valve metal base for the anode compartment, a transition metal base for the cathode compartment, a valve metal conductor welded to the valve metal base, a transition metal conductor welded to the transition metal base, the valve metal conductor and transition being electron beam welded to each other.

According to an alternative exemplification shown in FIG. 16 the electrical conductor element has a transition metal stud, plate, or disc 257 bonded, e.g., resistance welded to the base 223 of the cathode member 221, and a valve metal stud, plate, or disc 258 bonded, e.g., resistance welded to the base 203 of the anode member 201. The transition metal element 257 and the valve metal element 258 are bonded together, e.g., electron beam welded together e.g., at welds 255*a*.

Figure 17:
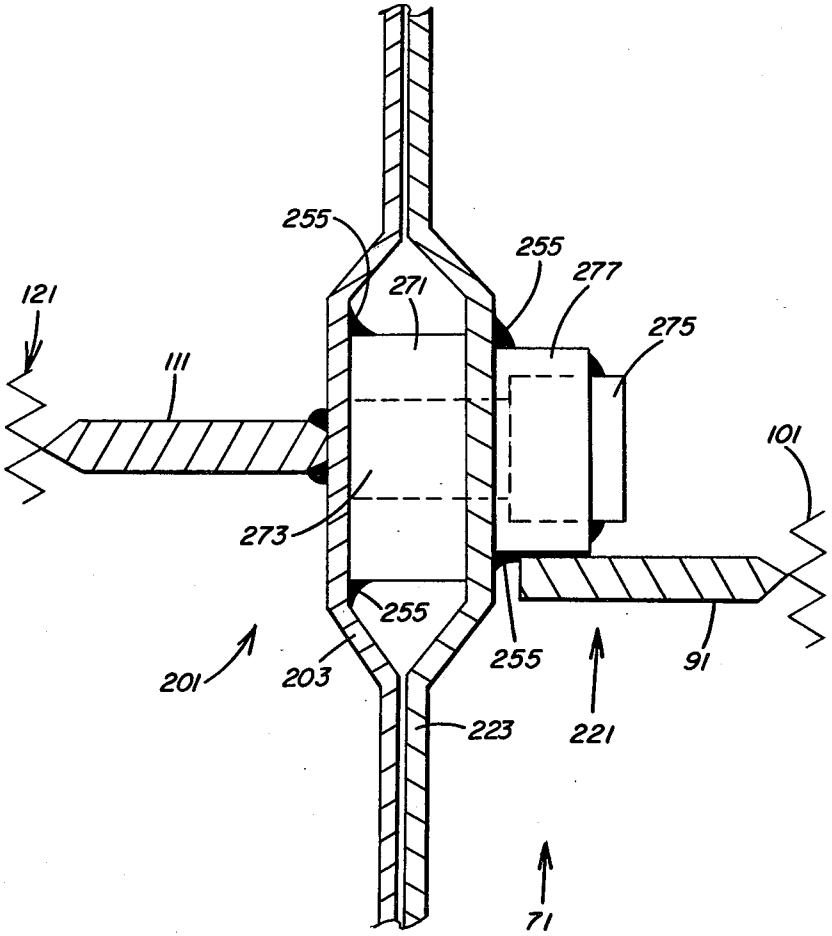
FIG. 17 is an element of a sectional plan view of a bipolar element having a valve metal base for the anodic compartment, a transition metal base for the cathodic compartment, an internally threaded valve metal conductor welded to the valve metal base, between the two compartments and a threaded bolt from the transition metal base to the valve metal conductor.

In an alternative exemplification of this invention, shown in FIG. 17, where the bipolar electrolyzer has a cathodic compartment 221 and an anodic compartment 201 arrayed in base-to-base 223, 203 configuration with an electrical conductor means therebetween, the electrical conductor means comprises an internally threaded valve metal stud 271 between the base 203 of the anodic compartment 201 and the base 223 of the cathodic compartment 221. The internally threaded titanium stud 271 is bonded to the base 203 of the anodic compartment 201.

A threaded bolt 273 passes through the base 223 of the cathode member 221 at an aperture therein corresponding to the internally threaded titanium stud 271. The threaded bolt 273 threadably engages the internally threaded titanium stud 271.

According to a further exemplification of the embodiment shown in FIG. 17, a cylindrical, hollow metal stud 135, fabricated of the same material as the base 223 of the cathode compartment, is bonded to the cathodic surface of the base 223 of the cathode compartment 221 and the threaded bolt 273 passes through the stud 277 and the cathode base. However, is to be understood that the head 275 of the threaded bolt 273 may directly contact, and even be bonded to the cathodic surface of the base 223 of the cathode compartment 221 and the cylindrical, hollow stud may be dispensed with.

FIGS. 18, 19 and 20 show exemplifications where an internally threaded stud is bonded to the anodic side of the bipolar element, a channelized transition metal stud is bonded to the cathodic side of the bipolar element, and a bolt passes from the channelized transition metal stud, through the partition, to the internally threaded valve metal stud. In FIG. 18 the partition 71 is formed of two plates, or sheets 73, 74, which may be held in compression. In FIG. 19 the bipolar element is trimetallic, with a structural unit 73 have a transition metal lining 83 and a valve metallic lining 79. In FIG. 20 the bases 203, 223, of the anode compartments 201 and of the cathode compartment 221 are held in compression.

While the exemplifications shown in FIGS. 18, 19, and 20 have a transition metal stud, the transition metal stud may be dispensed with, and the bolt head may compressively been directly on the partition.

In the alternative exemplification of the invention, shown in FIGS. 18 and 19, there is provided a bipolar element 71 having a cathodic compartment and an anodic compartment arrayed in base-to-base configuration, and electrically and mechanically in series with electrical conductor means therewith. The electrical conductor means comprise an internally threaded metal stud 131 bearing against the anolyte facing surface of the base of the anodic compartment at an aperture therein. A threaded bolt 133 passes through the aperture in the base of the anode compartment to the internally threaded metal stud 131, threadably engaging the internally threaded metal stud 131. The head of the bolt 133 bears either directly or indirectly upon the internal surface of the base of the cathode cmpartment.

Alternatively, an internally channelized transition metal member 135 may be bonded to the catholyte facing surface of the base of the cathode compartment, with the head of the bolt 133 bearing against the channelized member 135 or "O" rings or gas nets 137 thereon.

According to an alternative exemplification shown in FIG. 19 there is provided a bipolar electrolyzer having a partition wall 73 with an anodic lining 79 on one surface and a cathodic lining 83 on the opposite surface. The current conductor means comprises an internally threaded titanium stud 131 welded to the anodic partition 79, an iron stud 135 welded to the cathodic surface 83 on the partition and a threaded bolt 133 passing through the iron stud 135, the cathodic surface 83 of the partition, the metal partition 73, and the anolyte resistant partition 79 to the internally threaded titanium stud 131. The studs 131 and 135 are welded, for example at welds 255 to the respective walls 79 and 83 of the partition 73. The anodic current carrier 111 is welded to the titanium stud 131, e.g., at welds 255 and the anode 121 is bonded thereto.

The cathodic current collector 91 is bonded to, e.g., by welds 255, the steel stud 135 and the cathode 101 is bonded thereto.

The exemplification shown in FIG. 20 has a bipolar element with the base 203 of the anode compartment 201 bearing against the base 223 of the cathode compartment 221. The internally threaded valve metal stud 213 is bonded to the electrolyte facing surface of the base 203 of the anode compartment 201, at an aperture therein. The internally threaded valve metal stud 262 may be welded to the base 203 of the anode compartment 201, e.g., at welds 255.

The hollow or channelized transition metal studs 261 is bonded to the electrolyte facing surface of the base 223 of the cathode compartment 221, e.g., by welds 255, at an aperture therein. A bolt 261 passes through the transition metal stud 261 to the valve metal stud 262, threadably engaging the internal threads therein. The compression provides electrically conductive contact between the bases 203, 223 of the electrolyte compartments 201, 221.

The cathode conductor 91 is welded to the transition metal stud 211, e.g., by welds 255. The anode conductor 111 is welded to the valve metal stud 262, e.g., by welds 255.

In the exemplification shown in FIG. 21 an internally threaded stud 281 is provided between the base 203 of the anode compartment 201, and the base 223 of the cathode compartment 221. A threaded bolt 283 passes through an aperture in the base 203 of the anode compartment 201, threadably engaging the internally threaded stud 281 and providing an electrolyte tight seal between the base 203 of the anode compartment 201 and the threaded stud 281.

In one exemplification the internally threaded stud 281 may be welded directly to the base 223 of the cathode compartment 201. According to the alternative exemplification shown in FIG. 21, a second plate, sheet or stud 285 of transition metal is welded, e.g., at welds 255, to the internally threaded stud 281 and to the base 223 of the cathode compartment 221.

The cathode support member 91 is bonded, e.g., welded, to the plate or stud 285, when present. Alternatively, the cathode support member 91 is bonded, e.g., welded, at welds 255, directly to the threaded stud 281.

While FIG. 21 shows the anode support member 111 being bonded to the threaded bolt 283, and the threaded bolts 283 threadably engaging the internally threaded stud, it is to be understood that the cathode support means or a stud welded therato may threadably engage the internally threaded stud, which internally threaded stud may be welded to the base of the anode compartment.

According to an alternative exemplification shown in FIG. 22, the bipolar element 71 has a partition wall 73 separating the anolyte compartments from the catholyte compartments of adjacent electrolytic cells with internally threaded aperatures therein. The anolyte resistant liner 79 and the catholyte resistant liner 83 have apertures therein corresponding to the threaded aperture in the partition 73. Threaded bolt means 289 bear upon a liner, e.g., anolyte resistant liner 79 and threadably engage the partition 73 from one side, e.g., the anode side. Cathodic collar means 291 are bonded to the threaded bolt 289 within the aperture from the opposite side, e.g., the catholyte side of the partition 73. According to one exemplification, the collar 291 bears upon the partition 73 and the liner, e.g., the catholyte resistant liner 83, is bonded to the collar, e.g., collar 291 atop the collar.

According to an alternative exemplification, the partition, e.g., the catholyte resistant liner 83, remains flat upon the partition 73 and the liner, e.g., the catholyte resistant liner 83, is bonded to the collar 291 on the underside of the collar 291. According to an alternative exemplification, i.e., a mirror image of the exemplification shown in FIG. 22, the threaded stud means may extend inward from the cathodic surface of the bipolar element and the collar may be on the anodic side of the bipolar element.

In the exemplification shown in FIG. 22, the anode carrier 111 is bonded to the threaded stud 289 and to the anode 121 while the cathode carrier conductor 91 is bonded to the collar 291 and to the cathode 101.

In the exemplification shown in FIG. 24 the base 223 of the cathode compartment 221 has an aperture therein. A sheet 254 of a highly conductive metal, e.g., copper or silver, is welded, e.g., at welds 255, across the aperture. A stud 291 of high conductivity metal is welded, e.g., at welds 255, to the electrolyte facing surface of the sheet 254. The cathode conductor means 91 is bolted, by bolt 293 and nuts 295 to the stud 291.

A bimetallic element, 251, with a valve metal element 252 and a high conductivity metal element 253 is welded to the opposite surface of the sheet or plate 254. The bimetallic element 251 is welded to the valve metal base 203 of the anode compartment 201 at an aperture therein. The anode support means 111, i.e., the anode conductor, may be welded directly to the bimetallic element 251, on a further valve metal stud 287 may be welded there between.

According to an alternative exemplification, shown in FIG. 25, there is provided a bipolar electrolyzer having a plurality of individual bipolar elements 71 electrically in series. Each of the bipolar elements 71 has a cathodic first compartment, an anodic second compartment, and a metal partition 74 therebetween. The metal partition 74 is a bimetallic, copper valve metal cladding having the copper member 73 facing the catholyte compartment and the valve metal member 79 facing the anolyte compartment.

In an exemplification of the invention shown in FIG. 26 the base 223 of the cathodic member 221 and the base 203 of the anodic member 201 are in base-to-base configuration with a connector conductor means therebetween. The electrical conductor is a bimetallic element 251. A valve 252 metal-high conductivity metal 253 bimetallic element or a valve metal-transition metal bimetallic element with valve metal bonded to the base 203 of the anodic compartment 201, and a metal stud 285 bonded to the high conductivity metal or transition metal member 253 of the bimetallic element 251 and to the base 223 of the cathode compartment 221 at an aperture therein. In this way, cathode support means 91 may be bonded to the stud 285 at the aperture in the base 223 of the cathode compartment 221. The anode support means 111 may be bonded to the base 203 of the anode compartment 201 or bonded to the valve metal member 252 of the bimetallic element 251 at the aperture, not shown, in the anode base 201.

The permionic membrane interposed between the anode and the cathode is formed of a polymeric fluorocarbon copolymer having immobile, cation selective ion exchange groups on a halocarbon backbone. The membrane may be from about 2 to about 25 mils thick, although thicker or thinner permionic membranes may be utilized. The permionic membrane may be a laminate of two or more membrane sheets. It may, additionally, have internal reinforcing fibers.

The permionic membrane may be a copolymer of (I) a fluorovinyl polyether having pendant ion exchange groups and having the formula $$CF_2{-}CF{-}O_a{-}](CX'X'')_c(CFX')_d(CF_2{-}O{-}(X'X'')_e(CS''X'O{-}CF_2)_f]{-}A \quad (I)$$

where a is 0 or 1, b is 0 to 6, c is 0 to 6, d is 0 to 6, e is 0 to 6, f is 0 to 6; X, X', and X'' are —H, —Cl, —F, and $-(CF_2)_gCF_3$; g is 1 to 5; [ ] is a discretionary arrangement of the moieties therein; and A is the pendant functional group as will be described hereinbelow. Preferably a is 1, and X, X' and X'' are —F and $(CF_2)_gCF_3$.

The fluorovinyl polyether may be copolymerized with a (II) fluorovinyl compound $$CF_2{=}CF{-}O_a{-}(CFX''_d){-}A \quad (II)$$

and (III) perfluorinated olefin $$CF_2{-}CXX', \quad (III)$$

or (I) may be copolymerized with only a (III) perfluorinated olefin, or (I) may be copolymerized with only a (II) perfluorovinyl compound.

The functional group is a cation selective group. It may be a sulfonic group, a phosphoric group, a phosphonic group, a carboxylic group, a precursor thereof, or a reaction product thereof, e.g., an ester thereof. Carboxylic groups, precursors thereof, and reactions products thereof are preferred. Thus, as herein contemplated, A is chosen from the group consisting of —COOH,
$-COOR_1$,
—COOM,
—COF,
—COCl,
—CN,
$-CONR_2R_3$
$-SO_3H$,
$-SO_3M$,
$-SO_2F$, and
$-SO_2Cl$ where $R_1$ is a $C_1$ to $C_{10}$ alkyl group, $R_2$ and $R_3$ are hydrogen or $C_1$ to $C_{10}$ alkyl groups, and M is an alkali metal or a quaternary ammonium group. According to a preferred exemplification, A is —COCl,
—COOH,
$-COOR_1$,
$-SO_2F$, or
$-SO_2Cl$ where $R_1$ is a $C_1$ to $C_5$ alkyl.

According to a particularly preferred exemplification, A is chosen from the group consisting of —COCl,
—COOH, and
$-COOR_1$, where $R_1$ is a $C_1$ to $C_5$ alkyl, i.e., where A is a carboxylic acid group, a reaction product thereof, or a precursor thereof, whereby to provide a higher alkali metal hydroxide content in the catholyte product, at a current efficiency than that normally associated with sulfonyl, phosphonic, or phosphoric groups.

As herein contemplated, the permionic membrane is preferably a copolymer which may have: (I) fluorovinyl ether acid moieties derived from $$CF_2{=}CF{-}O{-}[CF_{2b}(CX'X'')_c(CFX')(CF_2{-}O{-}CX'X'')_e(CX'X''{-}O{-}CF_2)_f]{-}A,$$

exemplified by $$CF_2{=}CFOCF_2CF(CF_3)OCF_3CF_2CF_2COOOCH_3,$$

$$CF_2{=}CFO(CF_2)_3OCF(CF_3)COOCH_3,$$

$$CF_2{=}CFO(CF_2)_4OCF(CF_3)COOCH_3,$$

$$CF_2{=}CFOCF_2CF(CF_3)CF_2COOCH_3, \text{ and}$$

$$CF_2{=}CFOCF_2CF(CF_3)OCF(COOCH_3)CF_3, \text{ inter alia:}$$

(II) fluorovinyl moieties derived from $$CF_2{=}CF{-}(O)_a{-}(CFX')_d{-}A,$$

exemplified by $$CF_2{-}CF(CF_2)_{2\text{-}4}COOH_3,$$

$$CF_2{-}CF(CF_2)_{2\text{-}4}COOHCH_3,$$

$$CF_2{=}CFO(CF)_{2\text{-}4}COOH_3,$$

$$CF_2CF(CF_2)_{2\text{-}4}COOC_2H_5, \text{ and}$$

$$CF_2{=}CFO(CF_2)_{2\text{-}4}COOCH_3, \text{ inter alia;}$$

(III) fluorinated olefin moieties derived from $$CF_2{=}CXX'$$

as exemplified by tetrafluoroethylene, trichlorofluoroethylene, hexafluoropropylene, trifluoroethylene, vinylidene, fluoride, and the like; and (IV) vinyl ethers derived from $$CF_2{=}CFOR_4$$

The permionic membrane herein contemplated has an ion exchange capacity of from about 0.5 to about 2.0 milliequivalents per gram of dry polymer, preferably from about 0.9 to about 1.8 milliequivalents per gram of dry polymer, and in a particularly preferred exemplification, from about 1.0 to about 1.6 milliequivalents per gram of dry polymer. The permionic membrane herein contemplated has a volumetric flow rate of 100 cubic millimeters per second at a temperature of 150 to 300 degrees Centigrade, and preferably at a temperature between 160 to 250 degrees Centigrade. The glass transition temperature of the permionic membrane polymer is below 70° C., and preferably below about 50° C.

The permionic membrane herein contemplated may be prepared by the methods described in U.S. Pat. No. 4,126,588, the disclosure of which is incorporated herein by reference.

Most commonly the ion exchange resins will be in a thermoplastic form, i.e., a carboxylic acid ester, e.g., a carboxylic acid ester of methyl, ethyl, propyl, isopropyl, or butyl alcohol, or a sulfonyl halide, e.g., sulfonyl chloride or sulfonyl fluoride, during the fabrication herein contemplated, and will thereafter be hydrolyzed.

According to an alternative exemplification the permionic membrane has a porous, gas and liquid permeable, non-electrode layer bonded to either the anodic surface, or the cathodic surface, or both the anodic and cathodic surfaces thereof, as described in British Laid Open patent application No. 2,064,586 of Oda et al. As described by Oda et al the porous, non-catalytic, gas and electrolyte permeable, non-electrode layer does not have a catalytic action for the electrode reaction, and does not act as an electrode.

The porous, non-electrode layer is formed of a non hydrophobic material, either organic or inorganic. As disclosed by Oda et al the non-hydrophobic, non electrode material may be electrically non conductive. That is, it may have an electrical resistivity above 0.1 ohm-centimeter, or even above 1 ohm-centimeter. Alternatively, the porous, non-electrode layer may be formed of an electrically conductive material having a higher overvoltage than the electrode material placed outside the porous, non-electrode layer, that is, the porous, non-electrode layer may be formed of an electrically conductive material that is less electrocatalytic then the electrode material placed outside the porous, non-electrode layer.

The material is the porous, non-electrode layer is preferably a metal, metal oxide, metal hydroxide, metal nitride, metal carbide, or metal boride of a Group IVA metal, e.g., Si, Ge, Sn, or Pb, a Group IVB metal, e.g., Ti, Zr, or HF, a Group V-B metal, e.g., V, Nb, or Tn, a Group VIB metal, e.g., Cr, Mo, or W, or a Group VIII "iron Trial" metal, e.g., Fe, Co, or Ni. Especially preferred non-electrode materials are Fe, Ti, Ni, Zr, Ta, V, and Sn, and the oxides, hydroxides, borides, carbides, and nitrides thereof, as well as mixtures thereof.

Alternatively, the film, coating or layer, especially on the anodic side, may be formed of a perfluorocarbon polymer rendered suitably hydrophilic, i.e., by the addition of a mineral, as potassium titanate.

The non-electrode material is present in the porous film, coating, or layer as a particulate. The particles have a size range of from about 0.01 micron to about 300 microns, and preferably of from about 0.1 to 100 microns. The loading of particles is from about 0.01 to about 30 milligrams per square centimeter, and preferably from about 0.1 to about 15 milligrams per square centimeter.

The porous film, coating or layer has a porosity of from about 10 percent to 99 percent, preferably from about 25 to 95 percent, and in a particularly preferred exemplification from about 40 to 90 percent.

The porous film, coating or layer is from about 0.01 to about 200 microns thick, preferably from about 0.1 to about 100 microns thick, and in a particularly preferred embodiment, from about 1 to 50 microns thick.

When the particles are not directly bonded to and embedded in the permionic membrane a binder is used to provide adhesion. Typically the binder is of fluorocarbon polymer, preferably a perfluorocarbon polymer, as polytetraflonethylene, polyhexafluoropropylene, or a perfluoroalkoxy, or a copolymer thereof with an alejinically unsaturated perfluorinated acid, e.g., having sulfonic or carboxylic functionality.

The electrodes 101, 121, may either bear upon the porous, non-electrode surface or be spaced therefrom.

As contemplated herein, the current density of the electrolytic cell is higher than that in a conventional permionic membrane cell or diaphragm cell, for example, in excess of 200 amperes per square foot, and preferably in excess of 400 amperes per square foot. According to one preferred exemplification of this invention, electrolysis may be carried out at a current density of 400 or even 600 amperes per square foot, where the current density is defined as total current passing through the cell divided by the surface area of one side of the permionic membrane 33.

In order to attain the high current densities herein contemplated, a uniform current distribution across the face of the permionic membrane 99 is desirable. This may be accomplished by utilizing electrode substrates for the anode and the cathode having a high percentage of open area, e.g., above about 40 to 60 percent open area, and a narrow pitch, e.g., about 1.0 to 10 millimeters between substrate elements, meshes, or strands. A suitable substrate is mesh or screen having 2 to 25 or more strands per inch, where the strands are from about 1.0 to about 10 millimeters apart, centerline to centerline, and a diameter such as to provide at least about 40, and preferably above about 60 percent open area and from about 75 to about 400 openings per square centimeter. The mesh or screen is fabricated of a material that is resistant to the electrolyte, and electrically conductive. The resulting electrode has an electrocatalytic surface thereon. Alternatively, the electrode support may be a coated sheet or plate, having perforations on a pitch of 0.5 to 1.5 millimeters, and at least about 40 to 60 percent open area.

The cathode substrate is a metal that is resistant to aqueous alkali metal hydroxides present at the concentrations herein contemplated, i.e., from about 2 moles per liter of aqueous alkali metal hydroxide to about 15 moles per liter of aqueous alkali metal hydroxide, and generally from about 10 moles per liter of aqueous metal hydroxide to about 14 moles per liter of aqueous metal hydroxide. Suitable materials include mild steel, stainless steel, cobalt, nickel, silver, copper, and alloys of titanium with yttrium as described more fully in U.S. Pat. No. 4,075,020 to D. W. DuBois et al for electrode material and U.S. Pat. No. 4,133,730 to D. W. Duois et al for *Electrolysis of Brine Using Titanium Alloy Electrode.* Generally the materials of construction utilized in fabricating the cathode substrate are those materials also useful in fabricating the lining of those portions of the bipolar unit in contact with catholyte liquor.

The cathode electrocatalysts are adherent to the cathode substrate as a coating, layer, film, or deposit thereon. The cathode catalyst may be the same material as the cathode substrate, for example, rendered porous or electrically active by removal of a constituent thereof. Alternatively, and most frequently, the cathode electrocatalyst is a different material than the cathode substrate. Typical cathode electrocatalysts useful herein include various porous forms of nickel, i.e., as codeposited with a leachable such as aluminum or zinc wherein the aluminum or zinc is removed therefrom. Alternatively, the cathode electrocatalyst may be a compound of a platinum group metal, i.e., a compound of ruthenium or rhodium, or palladium, or osmium, or irridium, or platinum, or a combination thereof. Alternatively, the cathode electrocatalyst may be a high surface form of a platinum group metal as platinum black, platinized platinum, palladium black, or palladiumized palladium. According to a still further exemplification of this invention, the cathode electrocatalyst may be a high surface area compound of a transition metal as a compound comprising iron, or cobalt, or nickel, or manganese, or chromium, or molybdenum, or tungsten, vanadium, niobium, tantalum, titanium, or zirconium, or an oxide thereof, for example, manganese oxide, or iron oxide, or cobalt oxide, or nickel oxide, or a mild compound thereof as a mixed oxide of cobalt and nickel or an oxycompound comprising cobalt, nickel, and oxygen or cobalt, nickel, iron, and oxygen, or nickel, cobalt, and oxygen, or the like. According to a still further exemplification, the cathode electrocatalyst may contain rhenium, lead, tin, cadmium, mercury, silver, gold, or mixtures or compounds thereof.

The anode substrate is typically fabricated of a metal resistant to aqueous alkali metal chlorides in acidic media under reducing conditions. Such metals include the valve metals, i.e., those metals which form an oxide under the aforementioned conditions, such as titanium, zirconium, hafnium, vanadium, niobium, tantalum, and tungsten. Typically the anodic electrocatalyst is a material different from the anodic substrate and is present on the anodic substrate as a coating, film, layer, or deposit adherent thereto. Typical materials compounds of the platinum group metals, oxycompounds of the platinum group metals, oxycompounds of the platinum group metals with oxycompounds of film-forming metals, and oxycompounds of the platinum group metals, film-forming metals, and additional metallic constituents. Typical catalytic films, surfaces, coatings, and layers which may be applied to the anodic electrode substrate include platinum, platinumiridium, palladium oxide, palladium oxide in combination with an oxide of a valve metal, oxycompounds of ruthenium and titanium, and ruthenium and titanium with various other additives including gallium, indium, thalium, germanium, tin, lead, antimony, bismuth, copper, silver, gold, various of the transition metals, various of the rare earth metals, yttrium, and various alkaline earth metals.

The materials of construction used in fabricating the bipolar electrolyzer herein contemplated are those which are resistant to the electrolytes encountered during the conditions of electrolysis and resistant to corrosion during both electrolysis and its cell shut-down. These materials used for the cathode compartment include steel, stainless steel, nickel, and copper. Those used for the anode compartment include the valve metals, as described above, and most frequently titanium and alloys of titanium, such as alloys of titanium with molybdenum, alloys of titanium with palladium, alloys of titanium with nickel, and alloys of titanium with yttrium. Additionally, the entire bipolar electrolyzer may be prepared from an alloy of titanium and yttrium as described in U.S. Pat. No. 4,075,070 to DuBois et al for *Electrode Material* and U.S. Pat. No. 4,133,730 to DuBois et al for *Electrolysis of Brine Using Titanium Alloy Electrode.*

While the invention has been described with reference to certain particular exemplifications and embodiments thereof, the inventive concept sought to be protected is not to be limited thereby, but only by the claims appended hereto.

We claim:

1. A bipolar electrolyzer having a plurality of individual bipolar elements electrically in series, each of the bipolar elements comprising a cathodic first compartment having peripheral walls and a base, and an anodic second compartment having peripheral walls and a base, said cathodic compartment and said anodic compartment being arrayed in base-to-base configuration, and electrically and mechanically in series with electrical conductor means therebetween, said base of the cathodic first compartment having an aperture therein, the electrical conductor means passing therethrough;

(a) said cathodic, first compartment having:
  (i) cathode support means extending substantially perpendicularly outward from said base;
  (ii) cathode means bonded to the cathode support means, parallel to and spaced from the cathode compartment base, said cathode means being substantially planar and permeable to electrolyte and gases;

(b) said anodic, second compartment having:
  (i) anode support means extending substantially perpendicularly outward from said base;
  (ii) anode means bonded to the anode support means, parallel to and spaced from the anode compartment base, said anode means comprising an electrolyte and gas permeable electroconductive substrate, with an electrocatalytic coating thereon;

(c) each of said electrical conductor means passing from a cathode support means, through the base of the cathodic first compartment, and to the base of the anodic second compartment to a corresponding anodic support means; said electrical conductor means comprising:
  (i) a hollow metal cylinder welded to the cathodic facing side of the cathodic base member around an aperture therein, and having an apertured top remote from the cathode base member;
  (ii) a hollow, internally threaded nut welded to the cathode facing side of the anodic base member and concentrically arrayed within the hollow metal cylinder; and
  (iii) a bolt, the head of the bolt compressively bearing upon the apertured top of the hollow metal cylinder, the bolt passing through the aperture in the top of the metal cylinder, and threadably engaging the nut; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface thereof.

2. The bipolar electrolyzer of claim 1 wherein the bolt head is seal welded to the apertured top of the hollow steel cylinder.

3. The bipolar electrolyzer of claim 1 wherein the cathode support means is welded to the hollow steel cylinder.

4. A bipolar electrolyzer having a plurality of individual bipolar elements electrically in series, each of the bipolar elements comprising a cathodic first compartment having peripheral walls and a base, and an anodic second compartment having peripheral walls and a base, said cathodic compartment and said anodic compartment being arrayed in base-to-base configuration, and electrically and mechanically in series with electrical conductor means therebetween;

(a) said cathodic, first compartment having:
  (i) cathode support means extending substantially perpendicularly outward from said base;
  (ii) cathode means bonded to the cathode support means, parallel to and spaced from the cathode compartment base, said cathode means being substantially planar and permeable to electrolyte and gases;

(b) said anodic, second compartment having:
  (i) anode support means extending substantially perpendicularly outward from said base;
  (ii) anode means bonded to the anode support means, parallel to and spaced from the anodic compartment base, said anode means comprising an electrolyte and gas permeable electroconductive substrate, with an electrolcatalytic coating thereon;

(c) each of said electrical conductor means passing from a cathode support means, through the base of the cathodic first compartment, and to the base of the anodic second compartment to a corresponding anodic support means; said electrical conductor means comprising a bimetallic stud between the anode compartment base and the cathode compartment base, said bimetallic stud comprising:
  (i) a copper member welded to the cathode base; and
  (ii) a titanium member welded to the anode base; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface thereof.

5. The bipolar electrolyzer of claim 4 wherein the titanium member of the bimetallic stud is welded to the anode conductor means and the cathode conductor means is welded to the opposite surface thereof.

6. The bipolar electrolyzer of claim 4 wherein the cathode base has apertures therein, the copper member of the bimetallic stud is welded to the cathode base, and the cathode support means passes through the aperture and is welded to the copper member of the bimetallic stud.

7. The bipolar electrolyzer of claim 6 wherein the cathode support member is copper.

8. The bipolar electrolyzer of claim 4 wherein the cathode base has an aperture, the copper member of the bimetallic element is welded to the cathode base sealing the aperture, a metal plate is welded to the opposite surface of the cathode base sealing the aperture, the metal plate and the copper member of the bimetallic are welded to each other, and wherein hydrogen vent means are provided between the metal plate and the copper member of the bimetallic.

9. A bipolar electrolyzer having a plurality of individual bipolar elements electrically in series, each of the bipolar elements comprising a cathodic first compartment having peripheral walls and a base, and an anodic second compartment having peripheral walls and a base, said cathodic compartment and said anodic compartment being arrayed in base-to-base configuration, and electrically and mechanically in series with electrical conductor means therebetween;

(a) said cathodic, first compartment having:
  (i) cathode support means extending substantially perpendicularly outward from said base;
  (ii) cathode means bonded to the cathode support means, parallel to and spaced from the cathode compartment base, said cathode means being substantially planar and permeable to electrolyte and gases;

(b) said anodic, second compartment having:
  (i) anode support means extending substantially perpendicularly outward from said base;
  (ii) anode means bonded to the anode support means, parallel to and spaced from the anode compartment base, said anode means comprising an electrolyte and gas permeable electroconductive substrate, with an electrocatalytic coating thereon;

(c) each of said electrical conductor means passing from a cathode support means, through the base of the cathodic first compartment, and to the base of the anodic second compartment to a corresponding anodic support means, the said electrical conductor means comprising:
  (i) an iron plate welded to the back surface of the cathode base at an aperture therein, with cathode support means extending through the aperture and bonded to the iron plate; and
  (ii) an iron-titanium bimetallic element, the iron member thereof bonded to the iron plate, and the titanium member thereof bonded to the anode base; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface thereof.

10. The bipolar electrolyzer of claim 9 wherein the titanium member of the bimetallic element is bonded to the anode base at an aperture therein, and the anode support means pass through the aperture and are bonded to the titanium member of the bimetallic element.

11. The bipolar electrolyzer of claim 10 wherein the titanium member of the bimetallic element is resistance welded to the anode base.

12. The bipolar electrolyzer of claim 10 wherein the titanium member of the bimetallic element is electron beam welded to the anode base.

13. A bipolar electrolyzer having a plurality of individual bipolar elements electrically in series, each of the bipolar elements comprising a cathodic first compartmemt having peripheral walls and a base, and an anodic second compartment having peripheral walls and a base, said cathodic compartment and said anodic compartment being arrayed in base-to-base configuration, and electrically and mechanically in series with electrical conductor means therebetween;

(a) said cathodic, first compartment having:
  (i) cathode support means extending substantially perpendicularly outward from said base;

(ii) cathode means bonded to the cathode support means, parallel to and spaced from the cathode compartment base, said cathode means being substantially planar and permeable to electrolyte and gases;

(b) said anodic, second compartment having:

(i) anode support means extending substantially perpendicularly outward from said base;

(ii) anode means bonded to the anode support means, parallel to and spaced from the anode compartment base, said anode means comprising an electrolyte and gas permeable electroconductive substrate, with an electrocatalytic coating thereon;

(c) each of said electrical conductor means passing from a cathode support means, through the base of the cathodic first compartment, and to the base of the anodic second compartment to a corresponding anodic support means, said electrical conductor means comprising a titanium disc welded to the anode base, and a steel disc welded to the cathode base, the steel disc and the titanium disc being in compressive electrical conduct; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface.

14. A bipolar electrolyzer having a plurality of individual bipolar elements electrically in series, each of the bipolar elements comprising a cathodic first compartment having peripheral walls and a base, and an anodic second compartment having peripheral walls and a base, said cathodic compartment and said anodic compartment being arrayed in base-to-base configuration, and electrically and mechanically in series with electrical conductor means therebetween;

(a) said cathodic, first compartment having:

(i) cathode support means extending substantially perpendicularly outward from said base;

(ii) cathode means bonded to the cathode support means, parallel to and spaced from the cathode compartment base, said cathode means being substantially planar and permeable to electrolyte and gases;

(b) said anodic, second compartment having:

(i) anode support means extending substantially perpendicularly outward from said base;

(ii) anode means bonded to the anode support means, parallel to and spaced from the anode compartment base, said anode means comprising an electrolyte and gas permeable electroconductive substrate, with an electrocatalytic coating thereon;

(c) each of said electrical conductor means passing from a cathode support means, through the base of the cathodic first compartment, and to the base of the anodic second compartment to a corresponding anodic support means; the said electrical conductor means comprising:

(i) an internal threaded titanium stud, between the anode base and the cathode base, bonded to the anode base; and (ii) a threaded bolt, passing through the cathode base at an aperture therein, to the internal threaded titanium stud and threadably engaging the internal threaded titanium stud; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface thereof.

15. The bipolar electrolyzer of claim 14 wherein a cylindrical, hollow, iron stud is bonded to the cathodic surface of the cathode base, and the threaded bolt passes through the stud, and the cathode base.

16. A bipolar electrolyzer having a plurality of individual bipolar elements electrically in series, each of the bipolar elements comprising a cathodic first compartment having peripheral walls and a base, and an anodic second compartment having peripheral walls and a base, said cathodic compartment and said anodic compartment being arrayed in base-to-base configuration, and electrically and mechanically in series with electrical conductor means therebetween;

(a) said cathodic, first compartment having:

(i) cathode support means extending substantially perpendicularly outward from said base;

(ii) cathode means bonded to the cathode support means, parallel to and spaced from the cathode compartment base, said cathode means being substantially planar and permeable to electrolyte and gases;

(b) said anodic, second compartment having:

(i) anode support means extending substantially perpendicularly outward from said base;

(ii) anode means bonded to the anode support means, parallel to and spaced from the anode compartment base, said anode means comprising an electrolyte and gas permeable electroconductive substrate, with an electrocatalytic coating thereon;

(c) each of said electrical conductor means passing from a cathode support means, through the base of the cathodic first compartment, and to the base of the anodic second compartment to a corresponding anodic support means, said electrical conductor means comprising:

(i) an internal threaded titanium stud bonded to the anodic surface of the anode base at an aperture therein; and (ii) a threaded bolt, passing through the cathode base at an aperture therein, and through the aperture in the anode base, to the internal threaded titanium stud, and threadably engaging the internally threaded titanium stud; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface thereof.

17. The bipolar electrolyzer of claim 16 wherein a cylindrical, hollow, iron stud is bonded to the cathodic surface of the cathode base, and the threaded bolt passes through the stud and the cathodic base.

18. A bipolar electrolyzer having a plurality of individual bipolar elements electrically in series, each of the bipolar elements comprising a cathodic first compartment having peripheral walls and a base, and an anodic second compartment having peripheral walls and a base, said cathodic compartment and said anodic compartment being arrayed in base-to-base configuration, and electrically and mechanically in series with electrical conductor means therebetween;

(a) said cathodic, first compartment having:
  (i) cathode support means extending substantially perpendicularly outward from said base;
  (ii) cathode means bonded to the cathode support means, parallel to and spaced from the cathode compartment base, said cathode means being substantially planar and permeable to electrolyte and gases;

(b) said anodic, second compartment having:
  (i) anode support means extending substantially perpendicularly outward from said base;
  (ii) anode means bonded to the anode support means, parallel to and spaced from the anode compartment base, said anode means comprising an electrolyte and gas permeable electroconductive substrate, with an electrocatalytic coating thereon;

(c) each of said electrical conductor means passing from a cathode support means, through the base of the cathodic first compartment, and to the base of the anodic second compartment to a corresponding anodic support means, said conductor means comprising:
  (i) an internally threaded metal stud bearing against the cathode facing surface of the anode base at an aperture in said anode base;
  (ii) a threaded bolt passing through the aperture in the anode base to the internally threaded metal stud, the bolt threadably engaging the internally threaded metal stud, and the head of the bolt bearing upon the anodic surface of the anode base;
  (iii) a transition metal member bonded to the opposite surface of the internally threaded metal stud; the transition metal member bearing against the anode facing surface of the cathode base at an aperture therein; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface thereof.

19. The bipolar electrolyzer of claim 18 wherein the transition metal member is bonded to the anode facing surface of the cathode base at the aperture therein; and wherein the cathode support means passes through the aperture and is bonded to the transition metal member.

20. The bipolar electrolyzer of claim 18 wherein the transition metal member is internally threaded; and wherein a threaded bolt passes through the aperture in the cathode base member, the bolt threadably engaging the internally threaded transition metal member, and the head of the bolt bearing upon the cathode base.

21. A bipolar electrolyzer having a plurality of individual bipolar elements electrically in series, each of the bipolar elements comprising a cathodic first compartment having peripheral walls and a base, and an anodic second compartment having peripheral walls and a base, said cathodic compartment and said anodic compartment being arrayed in base-to-base configuration, and electrically and mechanically in series with electrical conductor means therebetween;

(a) said cathodic, first compartment having:
  (i) cathode support means extending substantially perpendicularly outward from said base;
  (ii) cathode means bonded to the cathode support means parallel to and spaced from the cathode compartment base, said cathode means being substantially planar and permeable to electrolyte and gases;

(b) said anodic, second compartment having:
  (i) anode support means extending substantially perpendicularly outward from said base;
  (ii) anode means bonded to the anode support means, parallel to and spaced from the anode compartment base, said anode means comprising an electrolyte and gas permeable electroconductive substrate, with an electrocatalytic coating thereon;

(c) each of said electrical conductor means passing from a cathode support means, through the base of the cathodic first compartment, and to the base of the anodic second compartment to a corresponding anodic support means, the conductor means comprising:
  (i) a copper sheet bonded to the cathode base at an aperture in the cathode base;
  (ii) a copper stud bonded to the copper sheet and extending through the aperture in the cathode base;
  (iii) a copper-titanium bimetallic element, the copper member thereof bonded to the copper sheet on the surface of the sheet opposite the copper stud, and the titanium member thereof bonded to the anode base at an aperture in the anode base;
  (iv) a titanium stud bonded to the titanium member of the bimetallic element at the aperture in the anode base and extending through the aperture; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface thereof.

22. The bipolar electrolyzer of claim 21 wherein the cathode support means is bonded to the copper stud.

23. The bipolar electrolyzer of claim 21 wherein the anode support means is bonded to the titanium stud.

24. A bipolar electrolyzer having a plurality of individual bipolar elements electrically in series, each of the bipolar elements comprising a cathodic first compartment having peripheral walls and a base, and an anodic second compartment having peripheral walls and a base, said cathodic compartment and said anodic compartment being arrayed in base-to-base configuration, and electrically and mechanically in series with electrical conductor means therebetween;

(a) said cathodic, first compartment having:
  (i) cathode support means extending substantially perpendicularly outward from said base;
  (ii) cathode means bonded to the cathode support means, parallel to and spaced from the cathode compartment base, said cathode means being substantially planar and permeable to electrolyte and gases;

(b) said anodic, second compartment having:

(i) anode support means extending substantially perpendicularly outward from said base;

(ii) anode means bonded to the anode support means, parallel to and spaced from the anode compartment base, said anode means comprising an electrolyte and gas permeable electroconductive substrate, with an electrocatalytic coating thereon;

(c) each of said electrical conductor means passing from a cathode support means, through the base of the cathodic first compartment, and to the base of the anodic second compartment to a corresponding anodic support means, said electrical conductor means comprising:

(i) a titanium-iron bimetallic element, the titanium member thereof being bonded to the anode base;

(ii) a steel stud bonded to the iron member of the bimetallic element, and to the cathode base at an aperture therein;

(iii) the cathode support means being bonded to the steel stud at the aperture in the cathode base, and the anode support means being bonded to the anode base; and (d) wherein the anodic compartment of one bipolar element and the cathodic compartment of the next adjacent bipolar element form an electrolytic cell, said anodic and cathodic elements being separated by a permionic membrane, with the anode means contacting one surface of the permionic membrane, and the cathode means contacting the opposite surface thereof.

* * * * *